US007143619B2

(12) United States Patent
Morikawa et al.

(10) Patent No.: US 7,143,619 B2
(45) Date of Patent: Dec. 5, 2006

(54) SPIN-FORMING METHOD, SPIN-FORMING APPARATUS, AND CATALYTIC CONVERTER

(75) Inventors: Junji Morikawa, Toyota (JP); Masashi Onuma, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 720 days.

(21) Appl. No.: 10/260,264

(22) Filed: Oct. 1, 2002

(65) Prior Publication Data

US 2003/0068256 A1 Apr. 10, 2003

(30) Foreign Application Priority Data

Oct. 9, 2001 (JP) ..... 2001-311346
Jul. 12, 2002 (JP) ..... 2002-203930

(51) Int. Cl.
*B21D 22/00* (2006.01)
*B21D 3/02* (2006.01)
*B21D 51/16* (2006.01)

(52) U.S. Cl. ..... 72/84; 72/82; 72/121; 72/125

(58) Field of Classification Search ..... 72/82, 72/83, 84, 85, 121, 125; 29/870
See application file for complete search history.

(56) References Cited

U.S. PATENT DOCUMENTS 5,937,516 A * 8/1999 De Sousa et al. ..... 29/890
6,067,833 A 5/2000 Irie
6,216,512 B1 * 4/2001 Irie ..... 72/121
6,467,322 B1 * 10/2002 Nogami et al. ..... 72/121

FOREIGN PATENT DOCUMENTS

| | | |
|---|---|---|
| EP | 0 916 426 A1 | 5/1999 |
| EP | 0 916 428 A2 | 5/1999 |
| EP | 1 025 923 A1 | 8/1999 |
| JP | 11-151535 | 8/1999 |
| JP | A 2001-25826 | 1/2001 |

* cited by examiner

*Primary Examiner*—Ed Tolan
(74) *Attorney, Agent, or Firm*—Oliff & Berridge, PLC

(57) ABSTRACT

While a material pipe and a roller are revolved relative to each other with a predetermined radius, the material pipe and the roller are moved relative to each other in the direction of progress of forming by eccentrically moving the center axis of the material pipe and the revolution axis of the roller relative to each other and simultaneously moving the material pipe and the roller relative to each other in the directions of the axis. During movement in the direction of progress of the forming, an end portion of the material pipe is deflected by controlling the axis-direction moving portion so that the roller is moved relative to the material pipe in the direction of the axis when the circumferential position of the roller, with respect to a circumference of the material pipe, changes from an inner side of the direction of deflection toward an outer side of the direction of deflection. This allows the movement of the roller relative to the material pipe in the direction of the axis to be stopped when the circumferential position of the roller changes from the outer side of the direction of deflection toward the inner side of the direction of deflection.

7 Claims, 17 Drawing Sheets

SPIN-FORMING METHOD, SPIN-FORMING APPARATUS, AND CATALYTIC CONVERTER

INCORPORATION BY REFERENCE

The disclosure of Japanese Patent Application No. 2001-311346 filed on Oct. 9, 2001 and No. 2002-203930 filed on Jul. 12, 2002 including the specification, drawings and abstract is incorporated herein by reference in its entirety.

BACKGROUND OF THE INVENTION

1. Field of Invention

The invention relates to a spin-forming method, a spin-forming apparatus, and a catalytic converter. More particularly, the invention relates to a spin-forming method and a spin-forming apparatus for modifying a material pipe into a shape with a predetermined angle, and a catalytic converter wherein a catalyst support is disposed within a catalyst container.

2. Description of Related Art

In a typical combustion engine, for example, a vehicular internal combustion engine and the like, the engine is connected to an exhaust system for conducting and discharging exhaust gas. The exhaust system is equipped with a catalytic converter for performing emission control by causing chemical reactions, such as oxidation, reduction and the like, of exhaust gas discharged from the combustion engine via an exhaust manifold.

The catalytic converter is formed by containing a catalyst support within a catalyst container. As shown in FIG. 20, a catalyst container 1" generally has a relatively large-diameter catalyst installation portion 1*a* that is disposed substantially at a middle portion of the catalyst container 1", in a lengthwise direction for containing a catalyst support 2. Relatively small-diameter joint portions 1*b* are disposed at opposite ends and are connected to the exhaust pipe of the internal combustion engine and to an outlet pipe, respectively. Funnel-shaped cone portions 1*c* are formed between opposite end portions of the catalyst installation portion 1*a* and the joint portions 1*b*, so that the diameter of each cone portion 1*c* gradually reduces from the end portion of the catalyst installation portion 1*a* toward the joint portion 1*b*.

In the production of a catalytic converter as described above, an ordinary spin-forming apparatus shown in FIGS. 1 and 2 is used to reduce the diameter of a hollow material pipe 1 so as to form a catalyst installation portion 1*a*, cone portions 1*c*, and joint portions 1*b* as one unit.

The spin-forming apparatus shown in FIGS. 1 and 2 has a clamp portion 11 for retaining a material pipe 1, a diameter-direction moving portion 12 for moving the material pipe 1 in a direction of a diameter of the material pipe 1, an axis-direction moving portion 13 for moving the material pipe 1 in the direction of an axis of the material pipe 1, a revolutional drive portion 14 for revolving a roller 10, that is, a forming tool, with respect to the material pipe 1, and a revolution radius changing portion (not shown) for changing the diameter of revolution of the roller 10.

In the production of a catalytic converter using a spin-forming apparatus as described above, a hollow material pipe 1 having substantially the same diameter as the catalyst installation portion 1*a* is held by the clamp portion 11. Then, the revolutional drive portion 14 revolves the roller 10, and the axis-direction moving portion 13 moves the material pipe 1 so that the roller 10 is positioned relative to the material pipe 1 so as to face a spin-forming initiation position on the material pipe 1, that is, a boundary between the catalyst installation portion 1*a* and a cone portion 1*c*. While the roller 10 is pressed against the material pipe 1 by the revolution radius changing portion (not shown), the material pipe 1 is moved by the axis-direction moving portion 13 so that the roller 10 moves relatively to the material pipe 1 in the direction of the axis thereof from the spin-forming initiation point toward an end of the material pipe 1. The catalyst support 2 wound on a mat 3 (see FIG. 20) is then inserted into the material pipe 1 from the other end portion thereof, which has not yet been spin-formed. Subsequently, the other end portion of the material pipe 1 is reduced in diameter by spin-forming.

The spin-forming apparatus shown in FIGS. 1 and 2 is also able to form a joint portion 1*b* eccentrically to the catalyst installation portion 1*a*. That is, it is formed in such a manner that a center axis C2 of the joint portion 1*b* lies apart from and parallel to a center axis C1 of the catalyst installation portion 1*a*, by relatively shifting the material pipe 1 in directions of the diameter during the spin-forming process.

Some catalyst containers 1", due to demands concerning arrangement of an exhaust system or the like, are formed in such a deflective fashion that the center axis C2 of a cone portion 1*c* and the adjacent joint portion 1*b* finally form a predetermined angle θ5 with respect to the center axis C1 of the catalyst installation portion 1*a* as indicated in FIG. 20. Some other catalyst containers 1" as shown in FIGS. 17 and 18 are formed in a deflective fashion such that a center axis C2 of the cone portion 1*c* and the joint portion 1*b* on one end side and a center axis C2 of the cone portion 1*c* and the joint portion 1*b* on the other end side form a predetermined angle therebetween about the center axis C1 of the catalyst installation portion 1*a* in a view as shown in FIG. 18, and thus are in different phases.

A related-art technology for processing a material pipe by a spin-forming process so as to, achieve a predetermined deflective angle with respect to the center axis of the material pipe is disclosed in Japanese Patent Application Laid-Open No. 11-151535. There exists a pipe-end forming method wherein a workpiece (material pipe) is subjected to a spinning process while the axis of the material pipe and the axis of revolution of a roll (forming tool) are tilted relatively to each other. There also exists a pipe-end forming method and apparatus wherein the axis of a workpiece pipe and the axis of revolution of a roll are tilted relatively to each other. The aforementioned laid-open patent application also describes a technology in which the roll is moved in radial directions with respect to the axis of revolution of the roll, while the roll is revolved around the axis of revolution, and the workpiece pipe is held so that the workpiece does not turn around its own axis.

The aforementioned patent application also indicates that in order to tilt the axis of the workpiece pipe and the axis of revolution of the roll with respect to each other, a clamp device for holding a workpiece is equipped with a workpiece tilter portion, such as an electric motor or the like, and the clamp device is turned by the tilter portion.

In the aforementioned related-art technologies, however, there is a need to equip a workpiece clamping device of a spin-forming apparatus with a workpiece tilter portion, such as a motor or the like, in order to tilt the axis of a workpiece (material pipe) and the axis of revolution of a roll (forming tool) relative to each other when a spinning process is performed to deflect the center axis of a cone portion and an adjacent joint portion with respect to the center axis of a catalyst installation portion as indicated in FIG. 20. Therefore, it is difficult or impossible to reduce the size or cost of the spin-forming apparatus.

If spin-forming is performed while the clamp portion is turned by the tilter portion so that the axis of a workpiece pipe and the axis of revolution of the roll are tilted relatively to each other, a boundary plane K between a cone portion 1*c* and the catalyst installation portion 1*a* of a catalyst container 1" is not substantially perpendicular to, but is oblique to the center axis C1 of the catalyst installation portion 1*a* as indicated in FIG. 20. The catalyst support 2 contained in the catalyst installation portion 1*a* typically has a generally cylindrical shape in which a center axis is substantially perpendicular to end surfaces. Therefore, the boundary plane K between the catalyst installation portion 1*a* and the cone portion 1*c*, and an end surface of the catalyst support 2 partially define a wedge-shaped space S in which the distance between the boundary plane K and the end surface of the catalyst support 2 varies in accordance with position. If such a spin-formed product is used as a catalyst container 1" of a catalytic converter as described above, exhaust gas is led from the cone portion 1*c* to the end surface of the catalyst support 2 via a space within the wedge-shaped space S, in which distance varies depending on position. Therefore, exhaust gas cannot be uniformly introduced into the catalyst support 2 via the entire end surface thereof, and exhaust gas cleaning efficiency cannot be improved.

Furthermore, in the catalyst container 1" formed so that the boundary plane K between the catalyst installation portion 1*a* and the cone portion 1*c* is oblique to the center axis C1 of the catalyst installation portion 1*a* as shown in FIG. 20, the presence of the wedge-like space S formed between the boundary plane and the end surface of the catalyst support increases the entire length L" of the catalyst container 1". As such, a large installation space is needed for the catalytic converter, and a large amount of material is needed to form a catalyst container, etc.

SUMMARY OF THE INVENTION

This invention has been accomplished in view of the aforementioned problems. It is an object of this invention to provide a spin-forming method that allows a material pipe to be easily deflected without tilting the center axis of the material pipe and the axis of revolution of a forming tool relative to each other as in the relational art.

Furthermore, in view of the aforementioned problems, it is another object of this invention to provide a spin-forming apparatus capable of easily deflecting a material pipe without a need to provide a workpiece tilter portion as in the related art and therefore capable of producing a spin-formed piece at low costs.

Further, in view of the aforementioned problems, it is another object of this invention to provide a catalytic converter that allows exhaust gas to be uniformly introduced to a catalyst via the entire surface of an end of a catalyst support and therefore improve the exhaust gas cleaning efficiency and allow reduction of the entire length of the catalytic converter.

In order to achieve the aforementioned objects and others, a spin-forming method in accordance with one aspect of this invention includes, but is not limited to, the steps of: revolving the material pipe and a forming tool relative to each other; and moving the forming tool relative to the material pipe in a direction of progress of the forming of the material pipe, by controlling a movement of the forming tool relative to the material pipe in a direction of an axis synchronously with a circumferential position of the revolving forming tool with respect to a circumference of the material pipe in accordance with a direction of deflection, while eccentrically moving a center axis of the material pipe and an axis of revolution of the forming tool relative to each other.

A spin-forming apparatus that performs the above-described method includes a revolutionary drive portion that revolves the forming tool relative to the material pipe, an axis-direction moving portion that moves the forming tool relative to the material pipe in a direction of an axis and a radial-direction moving portion that eccentrically moves the forming tool relative to the material pipe by moving the forming tool relative to the material pipe in a radial direction. This spin-forming apparatus also includes a reciprocating portion that reciprocally moves the material pipe and the forming tool relative to each other in the direction of the axis synchronously with a circumferential position of the revolving forming tool with respect to a circumference of the material pipe in accordance with the direction of deflection.

A catalytic converter produced by the above-described apparatus employing the spin-forming method may include a catalyst support disposed within a catalyst container, a relatively large-diameter catalyst installation portion that is formed in the catalyst container, so as to contain the catalyst support, a relatively small-diameter joint portion provided at an end of the catalyst container, and a generally frustum-shaped cone portion that is provided between the catalyst installation portion and the joint portion that is formed so as to gradually expand in diameter from the joint portion toward the catalyst installation portion. The catalytic converter is deflected such that a center axis of the joint portion and the cone portion forms a predetermined angle with respect to a center axis of the catalyst installation portion. The catalyst container is formed such that a boundary plane between the catalyst installation portion and the cone portion is substantially perpendicular to the axis of the catalyst installation portion.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
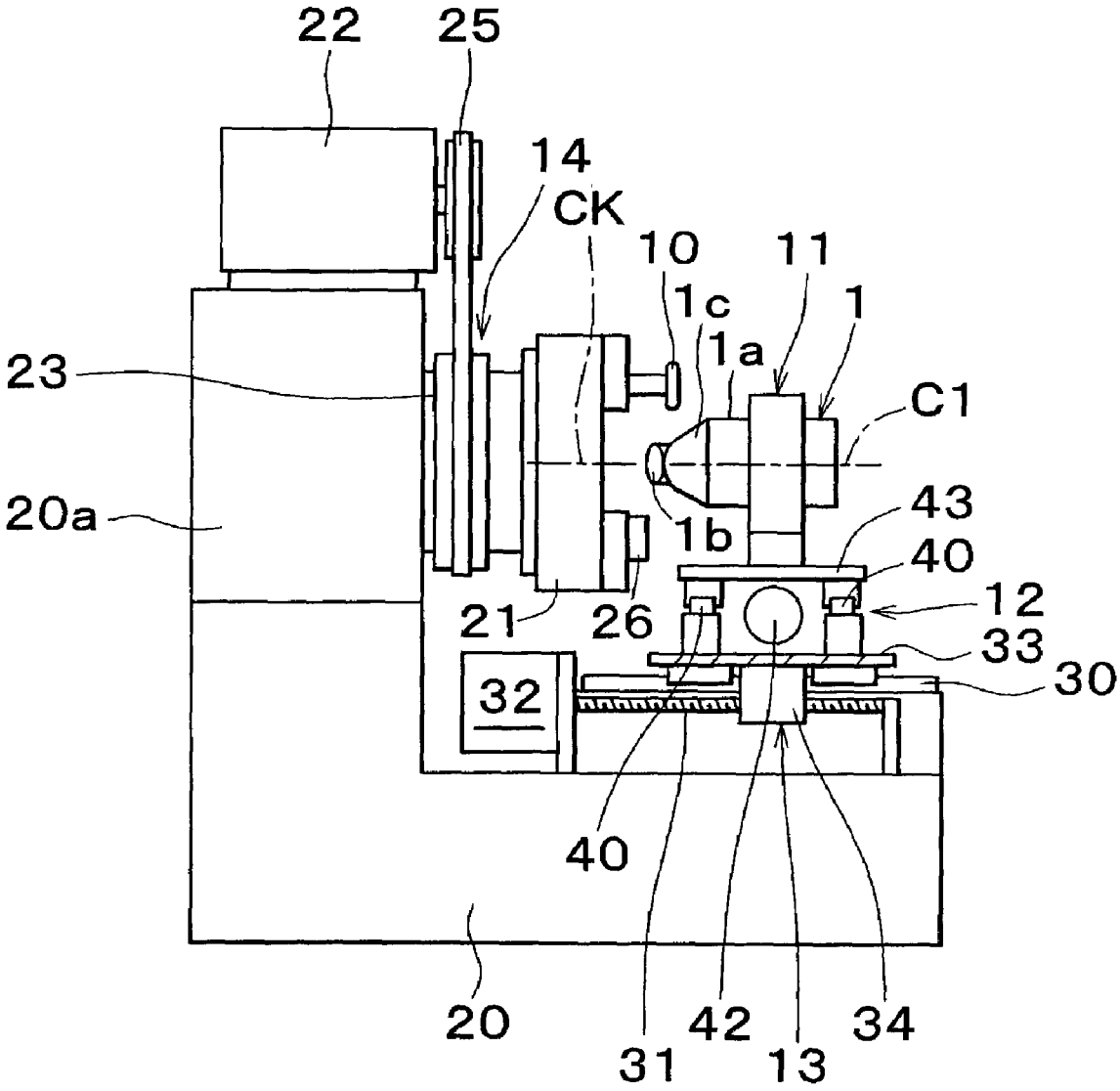
FIG. 1 is an elevation view of a typical spin-forming apparatus for use with the spin-forming method of the invention.

A spin-forming apparatus for use in a spin-forming method in accordance with the invention will be described with reference to FIGS. 1 and 2. This embodiment will be described in conjunction with a case where a material pipe 1 is spin-formed in order to produce a catalytic converter. However, the invention is not restricted by this embodiment, but is also applicable to the production of a hollow member that may be used for other purposes. In the drawings and the description below, like components and portions are represented by like reference characters.

The spin-forming apparatus in this embodiment generally has a clamp portion 11, a diameter-direction moving portion 12, an axis-direction moving portion 13, a revolutional drive portion 14, and a revolution radius changing portion (not shown).

The clamp portion 11 holds a material pipe 1. The diameter-direction moving portion 12 moves the material pipe 1 in a direction of a diameter of the material pipe 1. The axis-direction moving portion 13 moves a material pipe 1 in the directions of an axis of the material pipe 1. The revolutional drive portion 14 revolves a roller 10, that is, a forming tool, with respect to the material pipe 1. The revolution radius changing portion (not shown) changes the radius of revolution of the roller 10.

The revolutional drive portion 14 is provided at a side of a base 20. The clamp portion 11, the diameter-direction moving portion 12 and the axis-direction moving portion 13 are provided at another side of the base 20. The revolutional drive portion 14 may comprise, but is not limited to, a spindle 21, an electric motor 22, and a belt (or chain, or the like) power transfer mechanism 25.

The spindle 21 is rotatably supported on a column 20*a* standing from the base 20, and supports the roller 10 on its end surface such that the roller 10 is movable in a direction of a radius of revolution. The electric motor 22 is controllable so that the electric motor 22 turns at a predetermined rotation speed. The belt power transfer mechanism 25 includes a pulley 23 provided on the spindle 21, a pulley 24 provided on a rotation shaft of the electric motor 22, and a belt connecting the two pulleys 23 and 24, which are provided for transferring rotational drive power from the electric motor 22 to the spindle 21.

Figure 2:
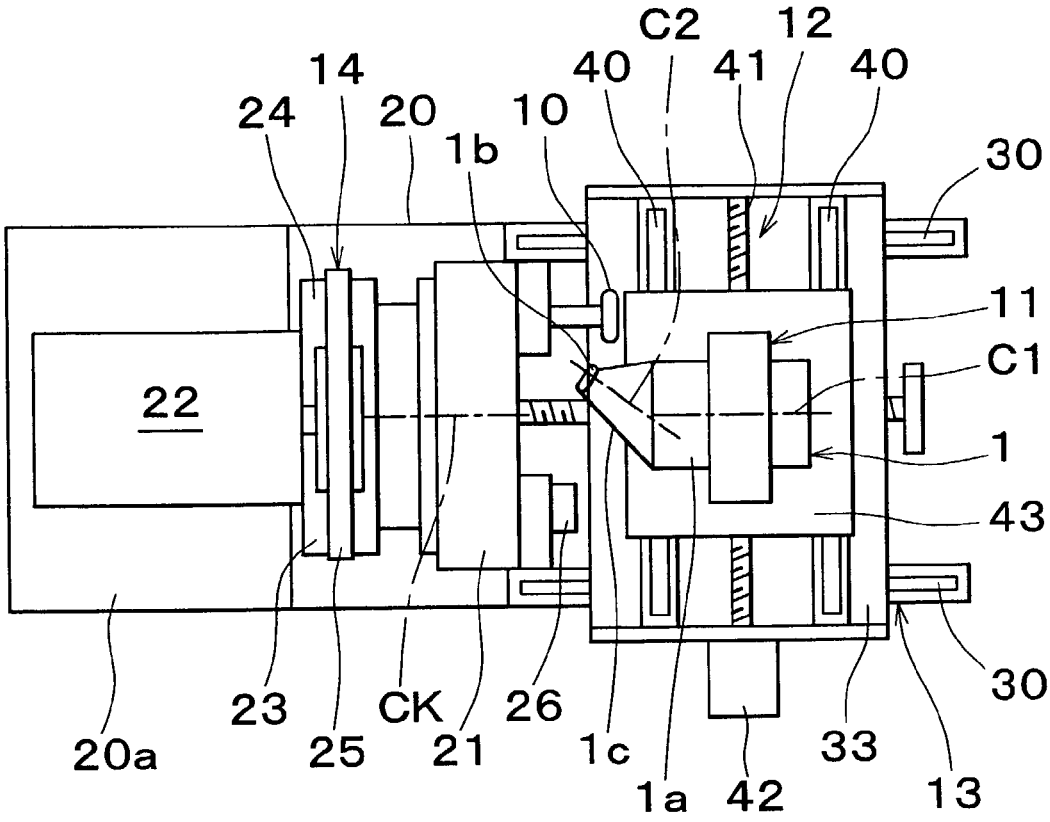
FIG. 2 is a plan view of the spin-forming apparatus shown in FIG. 1.

In the embodiment shown in FIGS. 1 and 2, the roller 10 is singly supported by the spindle 21. A counter balancer 26 is supported on the spindle 21, at a position opposite from the roller 10 in the direction of a diameter of the spindle 21. The revolution radius changing portion (not shown) moves the roller 10 and the counter balancer 26 in a direction of the diameter of the spindle 21. In FIGS. 1 and 2, a one-dot chain line CK indicates the axis of revolution of the roller 10.

The axis-direction moving portion 13 is substantially made up of a pair of guide rails 30, a ball screw shaft 31, a servo motor 32, an axis-direction movable table 33, and a ball screw nut 34.

The guide rails 30 are disposed on the base 20, and extend in parallel to the revolution axis CK of the roller 10. The ball screw shaft 31 extends between the guide rails 30 and parallel thereto, and is rotatable about an axis thereof. The servo motor 32 is connected to an end of the ball screw shaft 31, and rotates the ball screw shaft 31 about an axis thereof. The axis-direction movable table 33 is slidably disposed on the guide rails 30. The ball screw nut 34 is provided on a lower surface of the axis-direction movable table 33, and is screwed to the ball screw shaft 31.

As the servo motor 32 is operated, the axis-direction movable table 33 is moved to an arbitrary position at an arbitrary speed in a direction of the axis (right-left direction in FIGS. 1 and 2) via the ball screw nut 34 that is screwed to the ball screw shaft 31.

In this embodiment, the diameter-direction moving portion 12 is substantially made up of a pair of guide rails 40, a ball screw shaft 41, a servo motor 42, a diameter-direction movable table 43, and a ball screw nut 44.

The two guide rails 40 are disposed on the axis-direction movable table 33 so that the guide rails 40 are perpendicular to the revolution axis CK of the roller 10. The ball screw shaft 41 extends between the guide rails 40 and in parallel thereto, and is rotatable about an axis of the ball screw shaft 41. The servo motor 42 is connected to an end of the ball screw shaft 41, and rotates the ball screw shaft 41 about the axis thereof. The diameter-direction movable table 43 is slidably disposed on the guide rails 40. The ball screw nut 44 is provided on a lower surface of the diameter-direction movable table 43, and is screwed to the ball screw shaft 41.

When the servo motor 42 is operated, the diameter-direction movable table 43 is horizontally moved to an arbitrary position at an arbitrary speed in a direction of a diameter (up-down direction in FIGS. 1 and 2), via the ball screw nut 44 screwed to the ball screw shaft 41. The diameter-direction moving portion 12 is not limited to the embodiment in which the diameter-direction movable table 43 is horizontally moved as described above, but may also adopt a construction in which the diameter-direction movable table 43 is movable in directions other than the horizontal directions, for example, in vertical directions, as long as the directions are perpendicular to the revolution axis CK of the roller 10.

Figure 14:
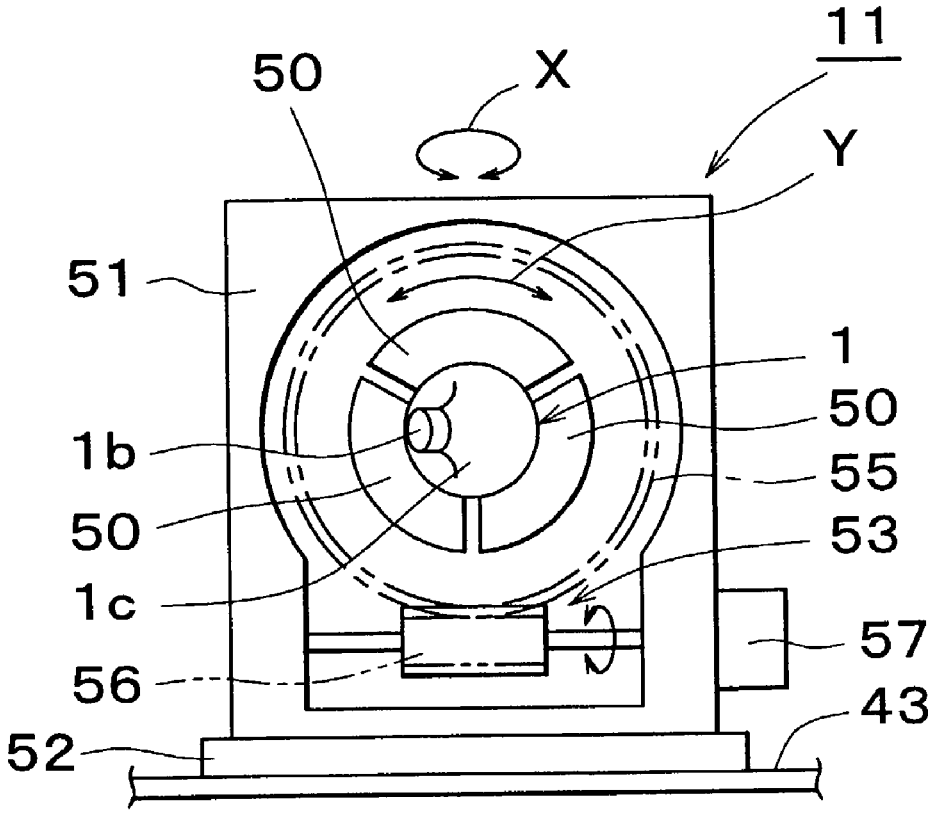
FIG. 14 is a diagram illustrating the construction of another embodiment of a clamp portion of this invention.

In the clamp portion 11, as shown in FIG. 14, a collet chuck 50 having a plurality of claws for gripping a material pipe 1 is supported on a frame 51 that is provided on the diameter-direction movable table 43.

Next, an embodiment of the spin-forming method of the invention will be described below in conjunction with a case where the spin-forming apparatus constructed as described above is used, with reference to FIGS. 3 to 9.

In the spin-forming method in accordance with this invention, while the material pipe 1 and the roller 10, that is, a forming tool, are being revolved relative to each other with a predetermined radius, the center axis C1 of the material pipe 1 and the revolution axis CK of the roller 10 are relatively deviated from each other. Simultaneously, the material pipe 1 and the roller 10 are moved relatively to each other in an axial direction, thereby moving the material pipe 1 and the roller 10 relative to each other in the forming direction of progress. During movement in the forming direction of progress, the axis-direction moving portion 13 is controlled so as to relatively move the roller 10 with respect to the material pipe 1 in the axial direction when the circumferential position of the roller 10 in a direction of a circumference of the material pipe 1 changes from an inner side of the direction of a deflection angle to an outer side of the direction of the deflection angle. When the position of the roller 10 in the circumferential direction shifts from the outer side of the direction of the deflection angle to the inner side of the direction of the deflection angle, the axis-direction moving portion 13 is controlled so as to stop relative movement of the roller 10 with respect to the material pipe 1 in the axial direction. Through this operation, an end portion of the material pipe 1 is deflected at a predetermined angle with respect to the center axis C1 of the portion of the material pipe 1 that is not subjected to the spin-forming.

Figure 3:
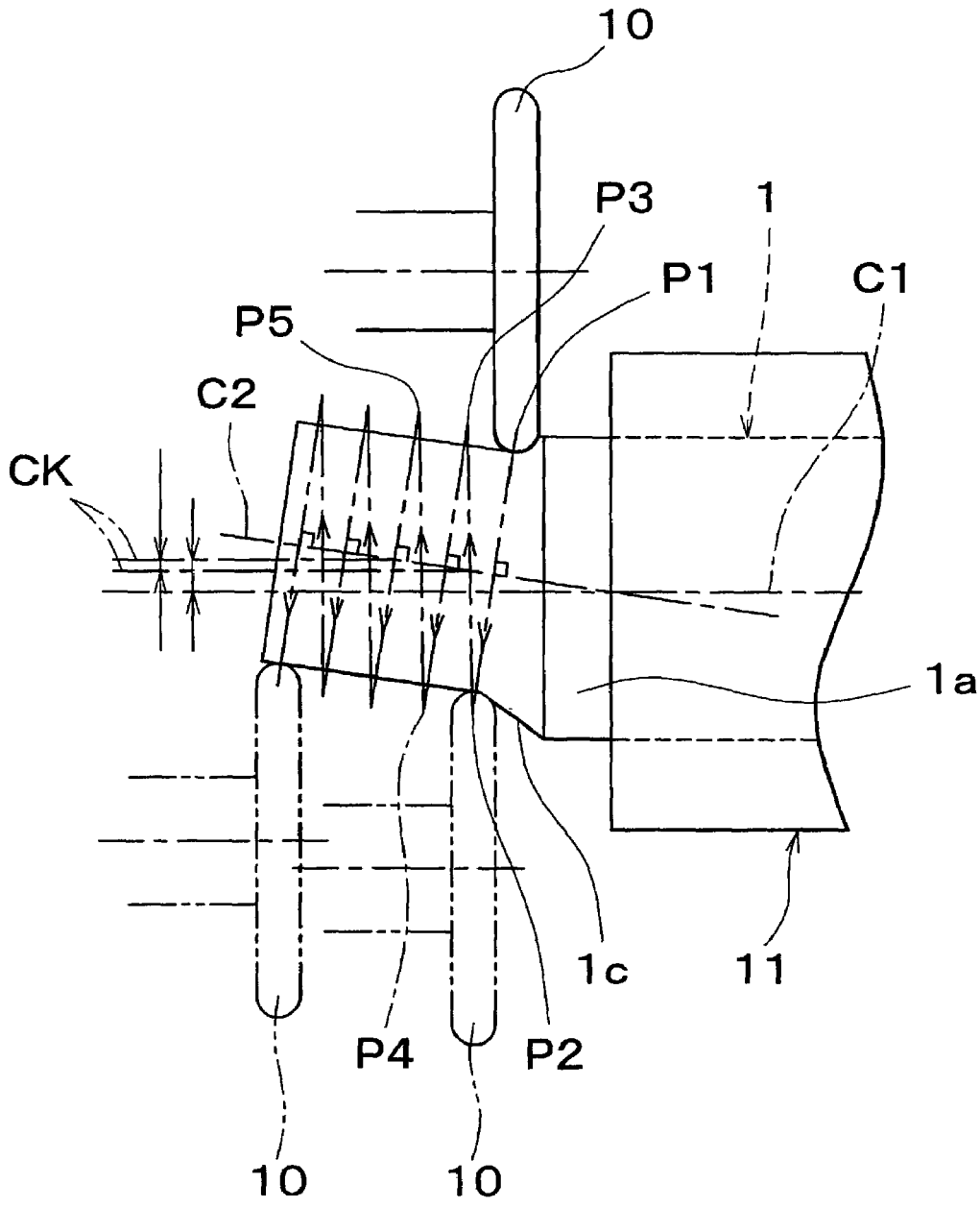
FIG. 3 is a schematic diagram illustrating a single process for the deflection of a material pipe in accordance with the invention.

FIG. 3 schematically illustrates a process (pass) of deflecting the material pipe 1 illustrated in FIGS. 4 to 8, for the purpose of illustrating the principle of the deflection. It should be noted that the roller 10 is moved relatively to the material pipe 1 from an intermediate portion to and an end portion of the material pipe 1. The aforementioned inner side of the direction of deflection refers to an upper side of a deflected portion of the material pipe 1 in FIG. 3. The aforementioned outer side of the direction of deflection refers to a lower side of the deflected portion of the material pipe 1 in FIG. 3.

For the production of a catalytic converter including the deflecting formation of a material pipe 1 through the spinning process, a material pipe 1 having substantially the same diameter as the catalyst installation portion 1*a* is first prepared, and the material pipe 1 is gripped by the collet chuck 50 of the clamp portion 11. At this moment, the material pipe 1 is placed by the diameter-direction moving portion 12 so that the center axis C1 of the material pipe 1 and the revolution axis CK of the roller 10 align on a single straight line. While this state is maintained, the material pipe 1 is moved in a direction of the axis thereof by operating the servo motor 32 of the axis-direction moving portion 13 so that the roller 10 comes to an initiation point of the spin-forming of the material pipe 1. Then, the radius of revolution of the roller 10 is adjusted by the revolution radius changing portion (not shown) to press the roller 10 into the material pipe 1 by a predetermined amount, and the electric motor 22 of the revolutional drive portion 14 is operated. While the roller 10 is revolved with a predetermined revolution radius being maintained, the material pipe 1 is moved eccentrically with respect to the revolution axis of the roller 10 by operating the servo motor 42 of the diameter-direction moving portion 12. Simultaneously, the servo motor 32 of the axis-direction moving portion 13 is operated to move the material pipe 1 generally in such a manner that the material pipe 1 is pulled away from the roller 10. The aforementioned direction of progress of forming refers to a direction of a movement of the material pipe 1 relative to the revolving roller 10 which is the resultant movement of an eccentric movement caused in a radial direction by the diameter-direction moving portion 12 and a movement in the direction of the axis caused by the axis-direction moving portion 13.

More specifically, when the circumferential position of the roller 10 with respect to a circumference of the material pipe 1 changes from positions P1, P3, . . . on the inner side of the direction of deflection toward positions P2, P4, . . . on the outer side of the direction of deflection, respectively, as indicated in FIG. 3, the servo motor 32 of the axis-direction moving portion 13 is operated and controlled synchronously with the position of the roller 10 with respect to the circumference of the material pipe 1. This occurs so that the roller 10 moves relatively on the material pipe 1 in the direction of the axis from an intermediate side to an end side of the material pipe 1. When the circumferential position of the roller 10 with respect to the circumference of the material pipe 1 changes from the positions P2, P4, . . . on the outer side of the direction of deflection to the positions P3, P5, . . . on the inner side of the direction of deflection, the servo motor 32 of the axis-direction moving portion 13 is controlled synchronously with the circumferential position of the material pipe 1 with respect to the circumference of the material pipe 1 such that the roller 10 does not move in the direction of the axis relatively to the material pipe 1.

Therefore, when the circumferential position of the roller 10 with respect to the circumference of the material pipe 1 changes from the positions P1, P3, . . . on the inner side of the direction of deflection toward the positions P2, P4, . . . on the outer side of the direction of deflection, material of the material pipe 1 elongates in a deflection direction outer-side portion in the direction of the axis. Therefore, unlike the conventional art, an end portion of the material pipe 1 can be deflected using a conventionally known ordinary spin-forming apparatus as shown in FIGS. 1 and 2 without the need to relatively tilt the center axis C1 of the material pipe 1 and the revolution axis CK of the roller 10 relative to each other. The loci of the roller 10 are formed when the circumferential position of the roller 10, with respect to the circumference of the material pipe 1, changes from the positions P1, P3, . . . on the inner side of the direction of deflection toward the circumferential positions P2, P4, . . . on the outer side of the direction of deflection. The loci of the roller 10 are perpendicular to the center axis C2 of a deflected portion of the material pipe 1. Therefore, the material pipe 1 can be appropriately pressed and reduced to smaller diameters with good precision.

Figure 4:
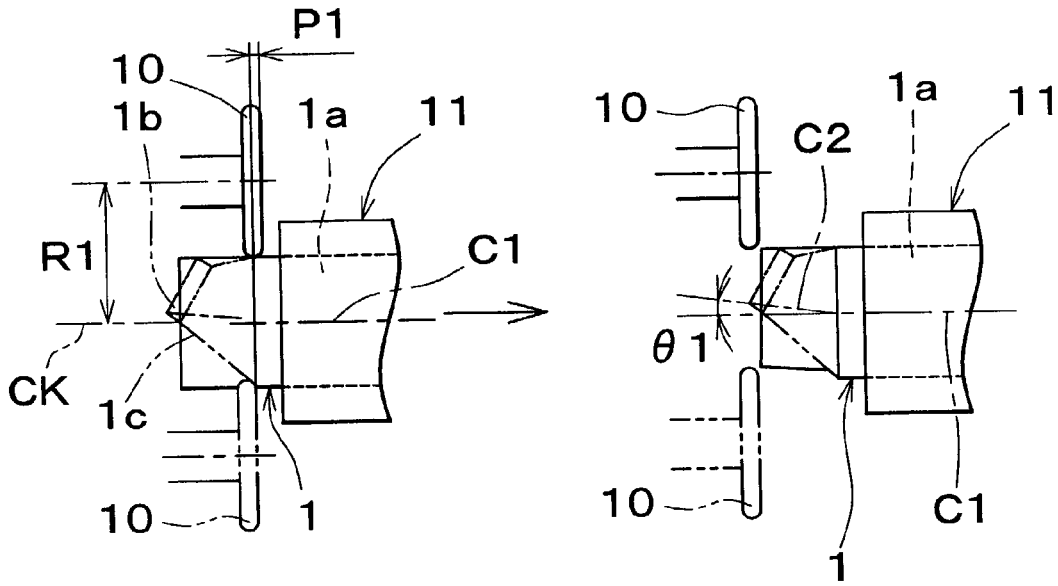
FIG. 4 is a diagram illustrating how a material pipe is deflected by a first process of this invention.

FIGS. 4 to 8 illustrate the deflective formation of a material pipe 1 into a catalyst container 1' having a cone portion 1*c* and a joint portion 1*b* as a one-piece body, in a sequence of processing steps. In FIG. 4, the spin-forming initiation point is set at a point on the boundary between the catalyst installation portion 1*a* and the cone portion 1*c* of the catalyst container 1'. The revolution radius changing portion (not shown) is set so that the radius of revolution of the roller 10 becomes R1. The moving speed ratio between the revolutional drive portion 14 and the axis-direction moving portion 13 is set so that the shift pitch in the direction of the axis from the positions P1, P3, . . . on the inner side of the direction of deflection to the positions P2, P4, . . . on the outer side of the direction of deflection becomes p1. The moving speed ratio between the axis-direction moving portion 13 and the diameter-direction moving portion 12 is set so that the pulling direction of the material pipe 1 (the direction of progress of the forming) becomes a predetermined angle θ1. Then, the roller 10 is pressed against the forming initiation point on the material pipe 1 so as to reach the radius of revolution R1 set by the revolution radius changing portion (not shown), and is revolved by the revolutionary drive portion. Furthermore, as described above, while the roller 10 is being revolved (see a leftward portion of FIG. 4), the material pipe 1 is eccentrically moved relative to the roller 10 by the diameter-direction moving portion 12. The roller 10 is also moved simultaneously by the cycle of moving and stopping the material pipe 1 in the direction of the axis of the material pipe 1 relative to the roller 10 synchronously with the circumferential position of the roller 10 through the repeated use of the axis-direction moving portion 13. This operation is continued until the roller 10 reaches an end portion of the material pipe 1. Then, the first processing step ends (see a rightward portion of FIG. 4). As a result, the spin-formed portion extending from the point on the boundary to the end portion of the material pipe 1 has a shape such that the center axis C2 (in the direction of progress of the forming) of the spin-formed portion is deflected at the angle θ1 with respect to the center axis C1 of the material pipe 1. A portion of the material pipe 1 adjacent to the point on the boundary is slightly reduced in diameter, and a portion extending therefrom to the distal end is reduced to a predetermined diameter. After that, the roller 10 is moved radially outward by the revolution radius changing portion (not shown) without allowing the roller 10 to contact the material pipe 1, and the axis-direction moving portion 13 and the diameter-direction moving portion 12 are operated to return the material pipe 1 to a predetermined position (described below) such that the roller 10 is positioned relative to the spin-forming initiation point of the subsequent processing step.

Figure 5:
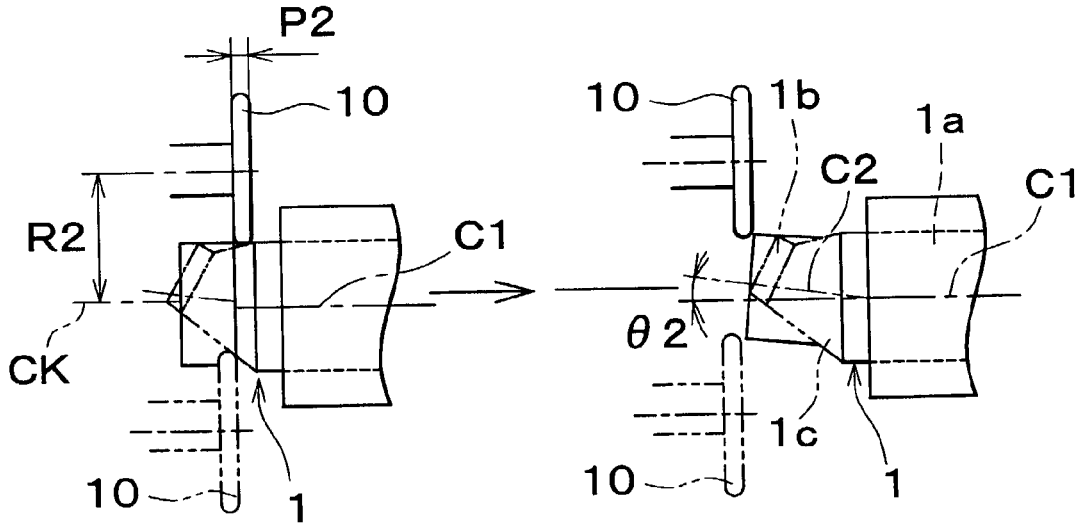
FIG. 5 is a diagram illustrating how the material pipe is further deflected from the state shown in FIG. 4 by a second process of this invention.

In the second processing step, the spin-forming initiation point is set at a diameter reduction end position in the first processing step, as indicated in FIG. 5. The revolution radius changing portion (not shown) is set so that the radius of revolution of the roller 10 becomes R2 (≦R1). The moving speed ratio between the revolutional drive portion 14 and the axis-direction moving portion 13 is set so that the shift pitch in the direction of the axis from the positions P1, P3, . . . on the inner side of the direction of deflection to the positions P2, P4, . . . on the outer side of the direction of deflection becomes p2 (≧p1). The moving speed ratio between the axis-direction moving portion 13 and the diameter-direction moving portion 12 is set so that the pulling direction of the material pipe 1 (the direction of progress of the forming) becomes a predetermined angle θ2 (≧θ1). Then, the roller 10 is pressed against the forming initiation point on the material pipe 1 so as to reach the radius of revolution R2 set by the revolution radius changing portion (not shown), and is revolved by the revolutionary drive portion (see a leftward portion of FIG. 5). Furthermore, as described above, while the roller 10 is being revolved, the material pipe 1 is eccentrically moved relatively to the roller 10 by the diameter-direction moving portion 12. Simultaneously, the cycle of moving and stopping the material pipe 1 in the direction of the axis of the material pipe 1 relative to the roller 10, synchronously with the circumferential position of the roller 10, through the use of the axis-direction moving portion 13 is repeated. This operation is continued until the roller 10 reaches an end portion of the material pipe 1. Then, the second processing step ends (see a rightward portion of FIG. 5). As a result, the spin-formed portion extending from the point on the boundary to the end portion of the material pipe 1 has a shape such that the center axis C2 (in the direction of progress of the forming) of the spin-formed portion is deflected at the angle θ2 with respect to the center axis C1 of the material pipe 1. Furthermore, a portion of the material pipe 1 adjacent to the point on the boundary is slightly reduced in diameter, and a portion extending therefrom to the distal end is reduced to a predetermined diameter. After that, as in the first processing step, the roller 10 is moved radially outward, and the material pipe 1 is returned to a predetermined position such that the roller 10 is relatively positioned to the spin-forming initiation point of the subsequent processing step.

Figure 6:
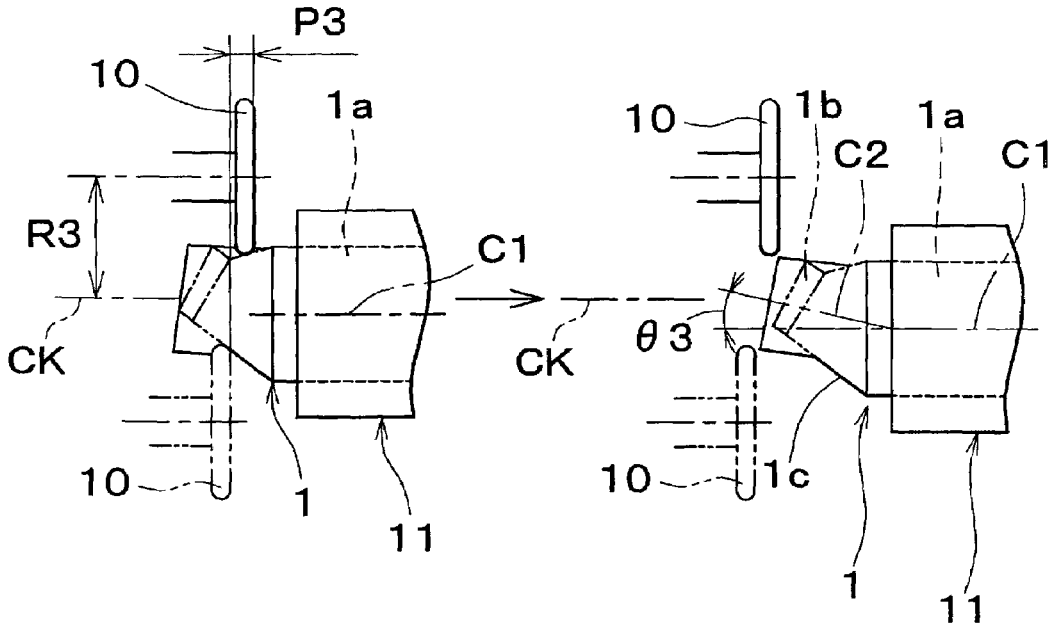
FIG. 6 is a diagram illustrating how the material pipe is further deflected from the state shown in FIG. 5 by a third process of this invention.

In the third processing step, the spin-forming initiation point is set at a diameter reduction end position in the second processing step, as indicated in FIG. 6. The revolution radius changing portion (not shown) is set so that the radius of revolution of the roller 10 becomes R3 (≦R2). The moving speed ratio between the revolutional drive portion 14 and the axis-direction moving portion 13 is set so that the shift pitch in the direction of the axis from the positions P1, P3, . . . on the inner side of the direction of deflection to the positions P2, P4, . . . on the outer side of the direction of deflection becomes p3 (≧p2). The moving speed ratio between the axis-direction moving portion 13 and the diameter-direction moving portion 12 is set so that the pulling direction of the material pipe 1 (the direction of progress of the forming) becomes a predetermined angle θ3 (≧θ2). The roller 10 is pressed against the forming initiation point on the material pipe 1 so as to reach the radius of revolution R3 set by the revolution radius changing portion (not shown), and is revolved by the revolutional drive portion 14 (see a leftward portion of FIG. 6). Furthermore, as described above, while the roller 10 is being revolved, the material pipe 1 is eccentrically moved relative to the roller 10 by the diameter-direction moving portion 12. The roller 10 is also moved simultaneously by the cycle of moving and stopping the material pipe 1 in the direction of the axis of the material pipe 1 relative to the roller 10 synchronously with the circumferential position of the roller 10 through the repeated use of the axis-direction moving portion 13. This operation is continued until the roller 10 reaches an end portion of the material pipe 1. Then, the third processing step ends (see a rightward portion of FIG. 6). As a result, the spin-formed portion, extending from a point on the boundary to the end portion of the material pipe 1, has a shape such that the center axis C2 (in the direction of progress of forming) of the spin-formed portion is deflected at the angle θ3 with respect to the center axis C1 of the material pipe 1. Furthermore, the diameter of the material pipe 1 is reduced continuously from the point on the boundary, and the diameter of a portion extending therefrom to the distal end is reduced to a predetermined value. After that, as in the first and second processing steps, the roller 10 is moved radially outward, and the material pipe 1 is returned to a predetermined position such that the roller 10 is relatively positioned to the spin-forming initiation point of the subsequent processing step.

Figure 7:
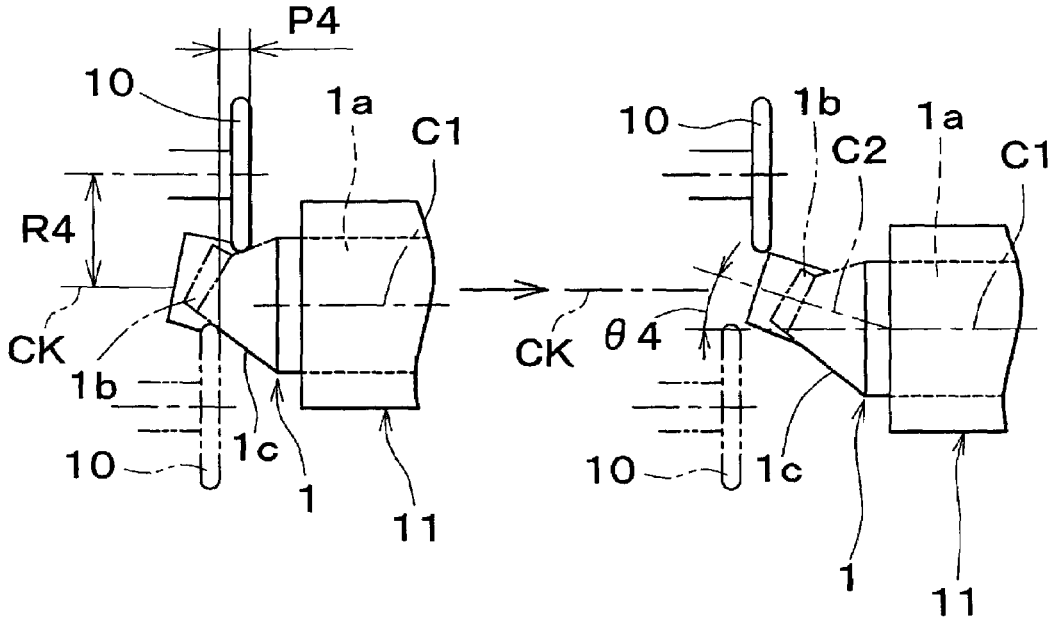
FIG. 7 is a diagram illustrating how the material pipe is further deflected from the state shown in FIG. 6 by a fourth process of this invention.

In the fourth processing step, the spin-forming initiation point is set at a diameter reduction end position in the third processing step, as indicated in FIG. 7. The revolution radius changing portion (not shown) is set so that the radius of revolution of the roller 10 becomes R4 (≦R3). The moving speed ratio between the revolutional drive portion 14 and the axis-direction moving portion 13 is set so that the shift pitch in the direction of the axis from the positions P1, P3, . . . on the inner side of the direction of deflection to the positions P2, P4, . . . on the outer side of the direction of deflection becomes p4 (≧p3). Furthermore, the moving speed ratio between the axis-direction moving portion 13 and the diameter-direction moving portion 12 is set so that the pulling direction of the material pipe 1 (the direction of progress of the forming) becomes a predetermined angle θ4 (≧θ3). The roller 10 is pressed against the forming initiation point on the material pipe 1 so as to reach the radius of revolution R4 set by the revolution radius changing portion (not shown), and is revolved by the revolutional drive portion 14 (see a leftward portion of FIG. 7). Furthermore, as described above, while the roller 10 is being revolved, the material pipe 1 is eccentrically moved relative to the roller 10 by the diameter-direction moving portion 12. The roller 10 is also moved simultaneously by the cycle of moving and stopping the material pipe 1 in the direction of the axis of the material pipe 1 relative to the roller 10 synchronously with the circumferential position of the roller 10 through the repeated use of the axis-direction moving portion 13. This operation is continued until the roller 10 reaches an end portion of the material pipe 1. Then, the fourth processing step ends (see a rightward portion of FIG. 7). As a result, the spin-formed portion extending from the point on the boundary to the end portion of the material pipe 1 has a shape such that the center axis C2 (in the direction of progress of the forming) of the spin-formed portion is deflected at the angle θ4 with respect to the center axis C1 of the material pipe 1. Furthermore, the diameter of the material pipe 1 is reduced continuously from a point on the boundary to a vicinity of the distal end, and the diameter of a portion extending therefrom to the distal end is reduced to a predetermined value. After that, as in the first to third processing steps, the roller 10 is moved radially outward, and the material pipe 1 is returned to a predetermined position such that the roller 10 is relatively positioned to the spin-forming initiation point of the subsequent processing step.

Figure 8:
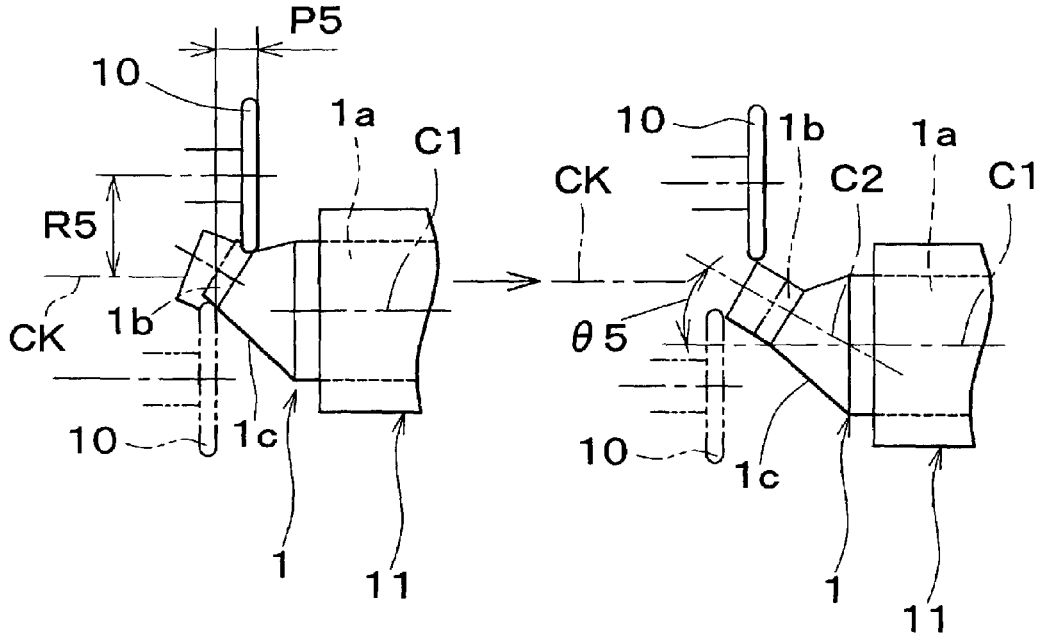
FIG. 8 is a diagram illustrating how the material pipe is further deflected from the state shown in FIG. 7 by a fifth process of this invention.

In the fifth processing step, the spin-forming initiation point is set at the diameter reduction end position in the fourth processing step, as indicated in FIG. 8. The revolution radius changing portion (not shown) is set so that the radius of revolution of the roller 10 becomes R5 (≦R4). The moving speed ratio between the revolutional drive portion 14 and the axis-direction moving portion 13 is set so that the shift pitch in the direction of the axis from the positions P1, P3, . . . on the inner side of the direction of deflection to the positions P2, P4, . . . on the outer side of the direction of deflection becomes p5 (≧p4). Furthermore, the moving speed ratio between the axis-direction moving portion 13 and the diameter-direction moving portion 12 is set so that the pulling direction of the material pipe 1 (the direction of progress of the forming) becomes a predetermined angle θ5 (≧θ4). The roller 10 is pressed against the forming initiation point on the material pipe 1 so as to reach the radius of revolution R5 set by the revolution radius changing portion (not shown), and is revolved by the revolutional drive portion 14 (see a leftward portion of FIG. 8). Furthermore, as described above, while the roller 10 is being revolved, the material pipe 1 is eccentrically moved relative to the roller 10 by the diameter-direction moving portion 12. The roller 10 is also moved simultaneously by the cycle of moving and stopping the material pipe 1 in the direction of the axis of the material pipe 1 relative to the roller 10 synchronously with the circumferential position of the roller 10 through the repeated use of the axis-direction moving portion 13. This operation is continued until the roller 10 reaches an end portion of the material pipe 1. Then, the fifth processing step ends (see a rightward portion of FIG. 8). As a result, the spin-formed portion extending from the point on the boundary to the end portion of the material pipe 1 has a shape such that the center axis C2 (in the direction of progress of the forming) of the spin-formed portion is deflected at the angle θ5, which is a final deflection angle, with respect to the center axis C1 of the material pipe 1. Furthermore, the diameter of the material pipe 1 is reduced continuously from the point on the boundary, whereby a cone portion 1*c* is formed. The diameter of a distal end portion is reduced to a predetermined value, whereby a joint portion 1*b* is formed.

Figure 9:
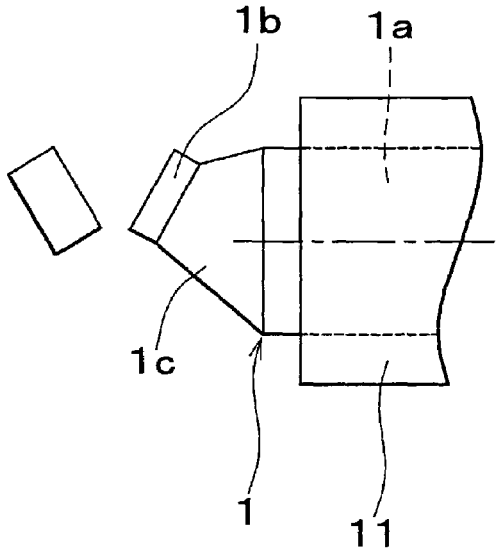
FIG. 9 is a diagram illustrating a state where the spin-forming of a predetermined configuration is completed by cutting an undesired distal portion from the formed end portion shown in FIG. 8.

After that, the distal-end joint portion 1*b*, reduced to a predetermined diameter, is cut to a predetermined length in accordance with a need as indicated in FIG. 9. Then, if a catalytic converter is to be produced, the catalyst support 2, for example, in a form in which the catalyst support 2 is wound on a mat 8 (see FIG. 19), is inserted into the pipe from the opposite end, which has not been subjected to spin-forming. After that, the opposite end of the pipe is also spin-formed as described above (see FIG. 16D).

This invention is not restricted by the aforementioned number of processing steps. The number of processing steps may be changed in accordance with the angle of deflection of the material pipe 1, or the like. This invention is not limited to a case where the above-described spin-forming apparatus is used. For example, this invention is also applicable to a case where a spin-forming apparatus is designed so that the roller 10 is movable in the directions of the axis and/or directions of a radius relative to the material pipe 1 is used. Furthermore, when the circumferential position of the roller 10, with respect to the circumference of the material pipe 1, changes from the positions P1, P3, . . . on the inner side of the direction of deflection toward the positions P2, P4, . . . on the outer side of the direction of deflection, the axis-direction moving portion 13 is controlled so as to relatively move the roller 10 from an intermediate portion side to an end side of the material pipe 1, or so as not to move the roller 10 in the direction of the axis relative to the material pipe 1. When the circumferential position of the roller 10 with respect to the circumference of the material pipe 1 changes from the positions P2, P4, . . . on the outer side of the direction of deflection toward the positions P3, P5, . . . on the inner side of the direction of deflection, the axis-direction moving portion 13 is controlled synchronously with the circumferential position of the roller 10 with respect to the circumference of the material pipe 1. This occurs so that the roller 10 is not moved in the direction of the axis relative to the material pipe 1, or so that the roller 10 is relatively moved in the direction of the axis from the end side toward an intermediate portion side of the material pipe 1.

Another embodiment of the spin-forming apparatus of the invention will next be described in detail with reference to FIGS. 10 and 11. Portions distinguishing this spin-forming apparatus from the above-described spin-forming apparatus will be described below. Portions that are the same as or comparable to those of the foregoing embodiment are represented by comparable reference characters, and will not be described below.

The spin-forming apparatus in accordance with this invention has a clamp portion 11, a diameter-direction moving portion 12, an axis-direction moving portion 13, a revolutional drive portion 14, a revolution radius changing portion (not shown), and a reciprocating portion 15. The clamp portion 11 grips a material pipe 1. The diameter-direction moving portion 12 moves a material pipe 1 in a direction of a diameter of the material pipe 1. The axis-direction moving portion 13 moves the material pipe 1 in a direction of an axis of the material pipe 1. The revolutional drive portion 14 revolves a roller 10, that is, a forming tool, with respect to the material pipe 1. The revolution radius changing portion changes the radius of revolution of the roller 10. The reciprocating portion 15 reciprocally moves the material pipe 1 and the roller 10 relative to each other in the directions of the axis synchronously with the circumferential position of the revolving roller 10 with respect to the circumference of the material pipe 1, in accordance with the direction of deflection.

Figure 10:
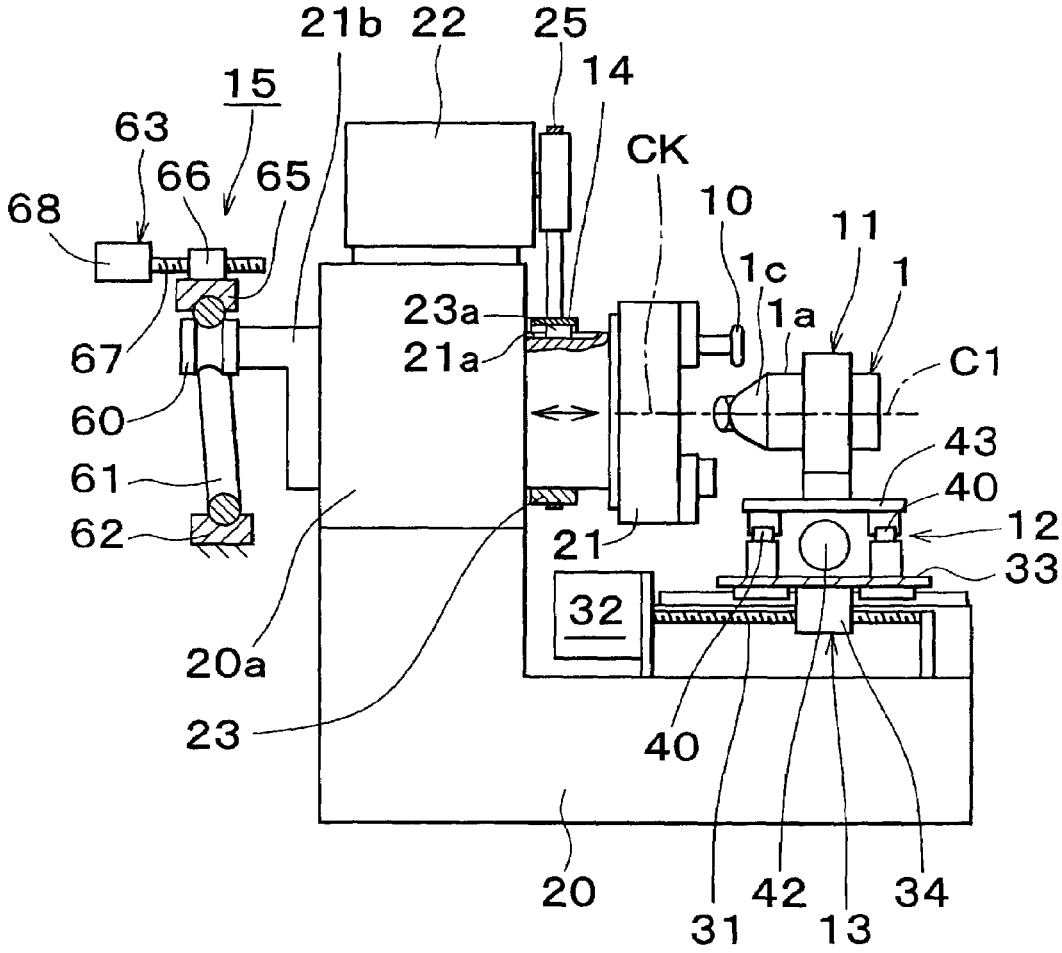
FIG. 10 is an elevation view of a spin-forming apparatus in accordance with this invention.

It should be noted herein that the phase of the reciprocating portion 15 indicated in FIG. 10 is different from a real phase for convenience in illustration.

As shown in FIG. 10, a spindle 21 of the revolutional drive portion 14 is supported by a column 20*a* so that the spindle 21 is rotatable and movable in the directions of the axis. A pulley 23 is provided so that the pulley 23 is allowed to slide in the directions of the axis, and is not allowed to relatively rotate.

The spindle 21 has a keyway 21*a* that extends in the direction of the axis. A key 23*a* is attached to an inner side of the pulley 23. The key 23*a* of the pulley 23 is slidably engaged with the keyway 21*a* of the spindle 21, so that the spindle 21 is prohibited from rotating relative to the pulley 23, and is allowed to move in the directions of the axis relative to the pulley 23.

The reciprocating portion 15 has a guide roller 60 that is rotatably provided on a rearward end (leftward end in FIG. 10) of the spindle 21, and a ring member 61 whose inner side contacts the guide roller 60. The reciprocating portion 15 also has a fixture member 62 that supports the ring member 61 so that the ring member 61 is tilted in accordance with the direction of deflection, and a ring member tilting mechanism 63 that controllably moves the ring member 61 in the directions of the axis.

A support shaft 21*b* is provided at a position that is a predetermined distance apart from a center axis of the rearward end of the spindle 21. The guide roller 60 is rotatably attached to the support shaft 21*b*. An outer peripheral surface of the guide roller 60 is formed in such a shape as to be engageable with the ring member 61. The ring member 61 is engaged with the fixture member 62 so that the ring member 61 can be tilted. A portion of the ring member 61 opposite from a portion engaged with the fixture member 62 is engaged with a movable member 65. The ring member tilting mechanism 63 is substantially made up of a ball screw nut 66 provided on the movable member 65, a ball screw shaft 67 screwed into the ball screw nut 66, and a servo motor 68 that rotates the ball screw shaft 67 about the axis thereof. By operating the servo motor 68 by a predetermined amount in an arbitrary direction, the movable member 65 is moved in the direction of the axis to tilt the ring member 61 to a predetermined angle. Since the guide roller 60 internally contacts the ring member 61, the roller 10 shifts in the directions of the axis synchronously with the revolution of the roller 10. The tilting direction of the ring member 61 is set in accordance with the direction of deflection of the material pipe 1.

The reciprocating portion 15 of this invention is not restricted by the form described above in conjunction with the embodiment. For example, although not shown, it is also possible to provide, instead of the fixture member 62, a rotatable shaft at an outward position that is located in a direction perpendicular to the direction from a center of the ring member 61 to the movable member 65 so that the ring member 61 can be rotated via the rotatably supported shaft. Furthermore, the ring member 61 and the guide roller 60 may be replaced by a cam and a cam follower. Furthermore, it is also possible to provide a ball screw mechanism on the rearward end of the spindle 21 so that the position of the spindle 21 in the directions of the axis is directly controlled by the ball screw mechanism.

Another embodiment of the spin-forming method of this invention will next be described in conjunction with the use of the above-described spin-forming apparatus. Portions that distinguish this embodiment from the foregoing embodiment will be described below, and portions that are the same as or comparable to those of the foregoing embodiment and are represented by comparable reference characters, and will not be described below.

In the foregoing embodiment, the material pipe 1 is moved in the direction of the axis relative to the roller 10 synchronously with the revolution of the roller 10 through the control of the axis-direction moving portion 13 only. In this embodiment, however, the material pipe 1, moved by the axis-direction moving portion 13 relative to the roller 10 in such a manner that the material pipe 1 is drawn apart from the roller 10, is moved in the direction of the axis by the reciprocating portion 15, synchronously with revolution of the roller 10 in accordance with the circumferential position of the roller 10.

Figure 11:
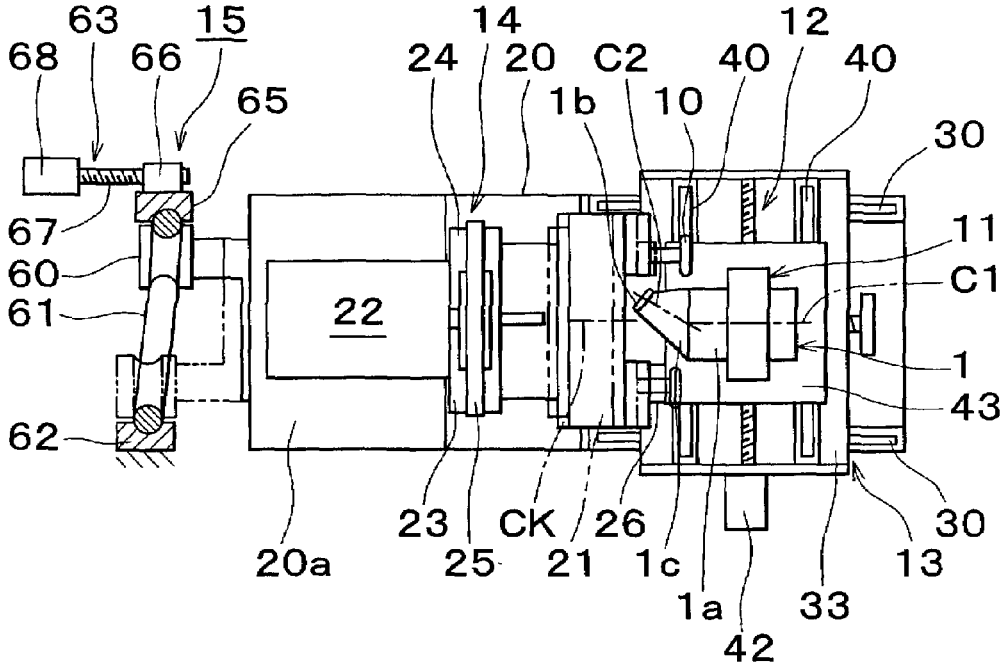
FIG. 11 is a plan view of the spin-forming apparatus shown in FIG. 10.

As shown in FIG. 11, the ring member 61 of the reciprocating portion 15 is tilted so that the roller 10 moves forward (see solid line in FIG. 11) when the roller 10 is on the inner side of the direction of deflection of the material pipe 1 so that the roller 10 moves backward (see a chain line in FIG. 11) when the roller 10 is on the outer side of the direction of deflection of the material pipe 1. The axis-direction moving portion 13 is set so as to move the material pipe 1 in the direction of the axis toward a side opposite to the roller 10 at a speed that is substantially equal to the speed the roller 10 moves from the backward position to the forward position.

According to the spin-forming apparatus constructed as described above, when the circumferential position of the roller 10 with respect to the circumference of the material pipe 1 changes from the positions P1, P3, . . . on the inner side of the direction of deflection to the positions P2, P4, . . . on the outer side of the direction of deflection, respectively, as indicated in FIG. 3, the roller 10 is moved backward so that the roller 10 moves relative to the material pipe 1 in the direction of the axis from an intermediate portion side to an end side in a drawn-apart fashion. When the circumferential position of the roller 10 with respect to the circumference of the material pipe 1 changes from the positions P2, P4, . . . on the outer side of the direction of deflection toward the positions P3, P5, . . . on the inner side of the direction of deflection, the roller 10 is moved forward. However, the forward movement of the roller 10 is cancelled out by the movement of the material pipe 1, achieved in the direction of the axis by the axis-direction moving portion 13, so that the relative positions of the roller 10 and the material pipe 1, in the direction of the axis, remain unchanged. Therefore, the roller 10 does not move relative to the material pipe 1 in the directions of the axis.

Therefore, this embodiment makes it possible to achieve the deflective forming of the material pipe 1 using the roller 10, as in the foregoing embodiment. In the foregoing embodiment, however, the movements of the roller 10 and the material pipe 1 in the direction of the axis are controlled only through operation of the servo motor 32 of the axis-direction moving portion 13, and therefore the construction is simple. However, in the foregoing embodiment, if the revolution speed of the roller 10 is great, it becomes difficult to control the servo motor 32 of the axis-direction moving portion 13 in accordance with revolution of the roller 10. Therefore, the foregoing embodiment is particularly effective if the revolution speed of the roller 10 is relatively low. In contrast, in this embodiment the reciprocating portion 15 reliably moves the roller 10 forward and rearward synchronously with revolution of the roller 10. Therefore, this embodiment is particularly effective if the revolution speed of the roller 10 is high.

Figure 12:
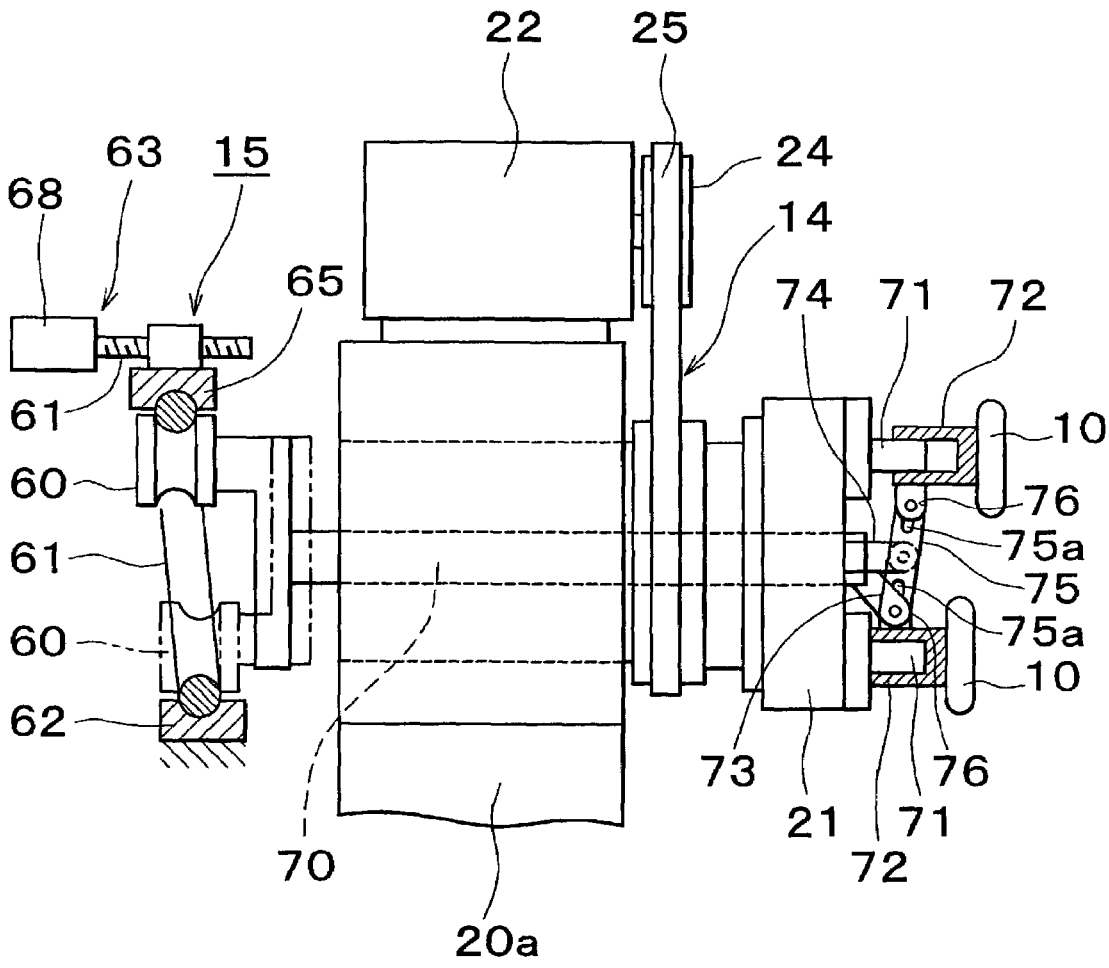
FIG. 12 is a partial view elevation illustrating another embodiment of a revolutionary drive portion and a reciprocating portion in the spin-forming apparatus of this invention.
Figure 13:
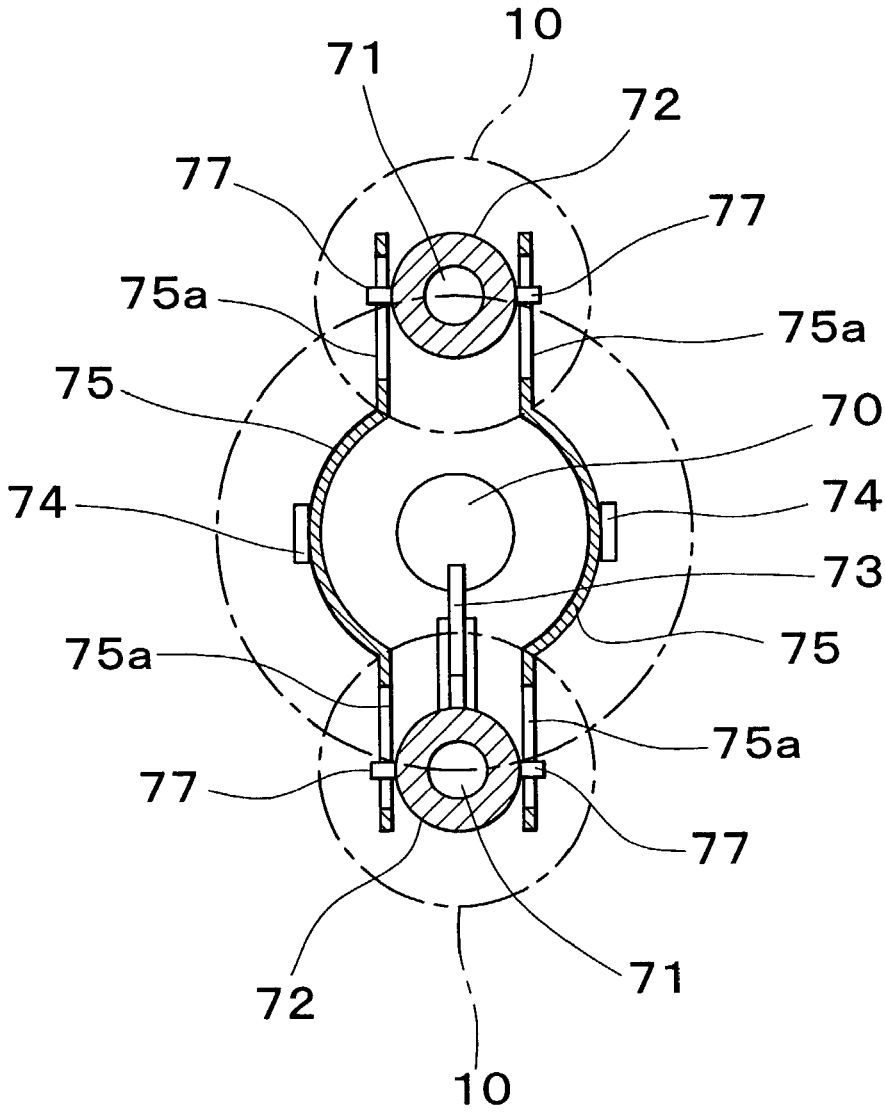
FIG. 13 is a partial sectional view illustrating portions of the spin-forming apparatus shown in FIG. 12.

Next, another embodiment of the revolutional drive portion 14 and the reciprocating portion 15 of the spin-forming apparatus of the invention will be described with reference to FIGS. 12 and 13. Portions of the embodiment that are the same as, or comparable to those of the foregoing embodiments will not be described below. Distinguishing portions will be described in detail.

In this embodiment, a spindle 21 of a revolutional drive portion 14 is supported by a column 20*a* so that the spindle 21 can be rotated relative to the column 20*a* without moving in the direction of the axis. A draw bar 70 is supported on a central portion of the spindle 21 so that the draw bar 70 is prevented from rotating relatively, but is allowed to move in the direction of the axis. A pair of support shafts 71 extend from a forward end surface of the spindle 21 in the direction of the axis. The support shafts 71 are moved in radial directions by a radial-direction moving portion (not shown). Fitted onto the support shafts 71 are sleeves 72 that rotatably support rollers 10. One of the sleeves 72 is connected to a distal end of the draw bar 70 by a connecting member 73. A bracket 74 is provided on the forward end surface of the spindle 21. A link 75 connecting the two sleeves 72 is pivotably attached at a central portion thereof to the bracket 74. FIG. 12 shows a construction in which each sleeve 72 is provided with a bracket 76 for connection to the link 75. FIG. 13 shows a construction in which each sleeve 72 is provided with a pin 77 for connection to the link 75. In either construction, the link 75 is provided with elongated holes 75*a* so that the sleeves 72 can be moved relative to the support shafts 71 in the direction of the axis without impeding movement of the rollers 10 in the radial direction caused by a revolution radius changing portion (not shown). At a rearward end of the draw bar 70, a reciprocating portion 15 is provided.

When the spin-forming apparatus constructed as described above is used, the spindle 21 is rotated by the electric motor 22 of the revolutional drive portion 14, with the ring member 61 of the reciprocating portion 15 tilted to a predetermined posture. As the spindle 21 rotates, the guide roller 60, in contact with an inner periphery of the ring member 61, rotates and therefore reciprocates the draw bar 70 in the direction of the axis. As the roller 10 connected to the draw bar 70 reciprocates in the direction of the axis, the other roller 10 is reciprocated in the direction of the axis opposite to the moving direction of the first roller 10 since the second roller 10 is connected to the first roller 10 by the link 75 pivoted at its central portion to the bracket 74. Therefore, when the guide roller 60 contacts a lower portion of the inner periphery of the ring member 61 as indicated in FIG. 12 (see chain lines), the draw bar 70 is moved or protruded rightward, moving the first roller 10 to a position in the direction of the axis indicated by the upper roller 10 shown in solid lines in FIG. 12, and moving the second roller 10 to a position in the direction of the axis indicated by the lower roller 10 shown in solid lines in FIG. 12.

At this time, the material pipe 1 is eccentrically moved by the diameter-direction moving portion 12, and is moved in the direction of the axis by the axis-direction moving portion 13 in such a manner that the material pipe 1 is withdrawn from the revolving rollers 10. Therefore, as in the foregoing embodiments, the two rollers 10 are operated and controlled so that when the circumferential position of a roller 10 with respect to the circumference of the material pipe 1 changes from the positions P1, P3, . . . on the inner side of the direction of deflection toward the positions P2, P4, . . . on the outer side of the direction of deflection, the roller 10 moves relatively in the direction of the axis from an intermediate portion side to an end side of the material pipe 1 as indicated in FIG. 3. Furthermore, when the circumferential position of a roller 10 with respect to the circumference of the material pipe 1 changes from the positions P2, P4, . . . on the outer side of the direction of deflection toward the positions P3, P5, . . . on the inner side of the direction of deflection, the roller 10 is operated synchronously with the circumferential position of the roller 10 with respect to the circumference of the material pipe 1 in such a fashion that the roller 10 does not move in the direction of the axis relative to the material pipe 1. Therefore, an end portion of the material pipe 1 is appropriately pressed and is reduced in diameter with good precision, and is deflected. Since the two rollers 10 are used in this embodiment, the spin-forming can be efficiently accomplished within a short time.

Another embodiment of the clamp portion 11 of the spin-forming apparatus of the invention will be described below after description of a product in which installation of the clamp portion 11 is desirable with reference to FIGS. 17 and 18.

Figure 17:
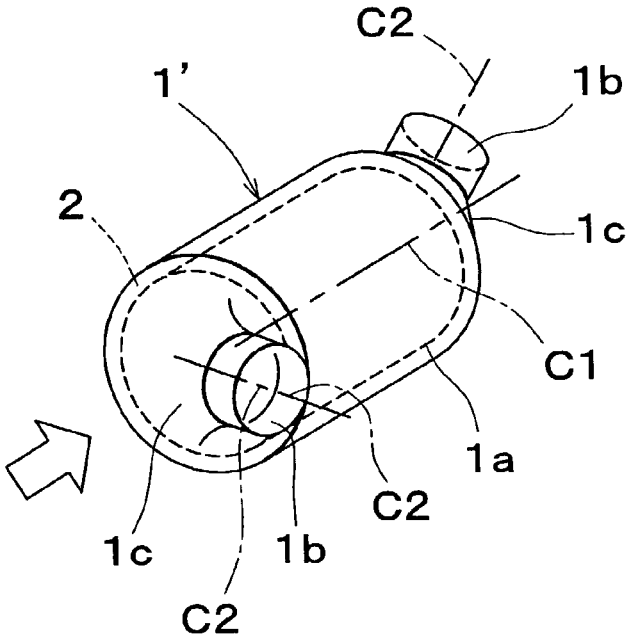
FIG. 17 is a perspective view illustrating a catalytic converter as a product formed in accordance with this invention, in which the cone portion and the joint portion at one end have a skew position relationship with the cone and the joint portion at the other end.
Figure 18:
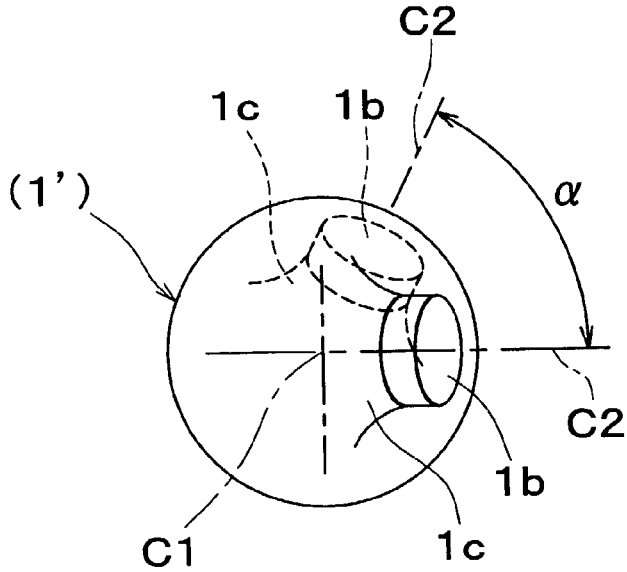
FIG. 18 is an elevation view taken in a direction indicated by an arrow in FIG. 17.

FIGS. 17 and 18 show a catalytic converter obtained by deflection-forming the material pipe 1 through spin-forming. In some cases, it is necessary to form a catalyst container 1' in which the cone portion 1*c* and the joint portion 1*b* are located at one end of the catalyst container 1', and the cone portion 1*c* and the joint portion 1*b* located on the other end have a skew-positional relationship with an angle a formed therebetween. In such a case, an end portion of the material pipe 1 is subjected to spin-forming as described above, so as to form a cone portion 1*c* and a joint portion 1*b* with a deflection angle. After that, a catalyst support 2 wound on a mat 3 (see FIG. 19) is inserted into the material pipe 1 from the other end. Then, the other end portion is subjected to spin-forming so as to form a cone portion 1*c* and a joint portion 1*b* while the material pipe 1 is held in such a posture that the other end portion will form the angle $\alpha$ with respect to the first end portion.

Figure 15:
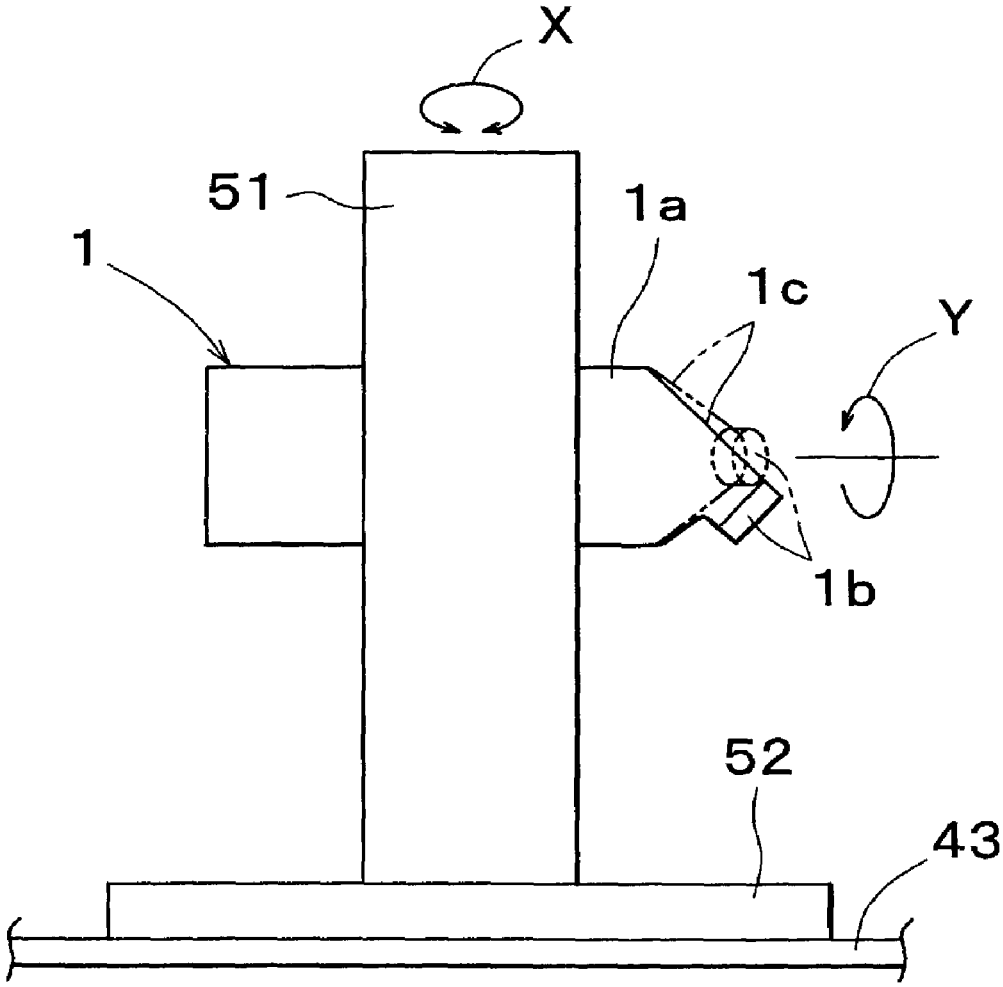
FIG. 15 is a side view of the clamp portion shown in FIG. 14.

In an embodiment shown in FIGS. 14 and 15 or FIG. 16, the clamp portion 11 has a rotating portion 52 that rotates a frame 51 of the clamp portion 11 for positioning, and a phase changing portion 53 that turns the material pipe 1 about the center axis C1 to change the phase, so that an end of a material pipe 1 and the other end thereof can be spin-formed by the roller 10.

The rotating portion 52 is disposed between the frame 51 and a diameter-direction moving table 43. The rotating portion 52 turns the frame 51 by 180° in the direction indicated by arrows X relative to the diameter-direction moving table 43, and positions the frame 51 so that the center axis C1 of the material pipe 1, gripped by a collet chuck 50, becomes parallel to the revolution axis CK of a roller 10.

In the phase changing portion 53 in the embodiment shown in FIGS. 14 and 15, the collet chuck 50 is supported rotatably about the axis thereof relative to the frame 51 (see arrows Y in FIGS. 14 and 15), and the collet chuck 50 is provided within a worm wheel 55. The worm wheel 55 is meshed with a worm 56. An electric motor for rotating the worm 56 is provided on the frame 51.

In the clamp portion 11 constructed as described above, after the deflective formation of an end portion of the material pipe 1 is complete, the electric motor 57 is operated to rotate the worm 56 about its axis so that the material pipe 1, gripped by the collet chuck 50, provided inside the worm wheel 55 is turned an angle a in a direction indicated by an arrow Y about the axis of the material pipe 1. Then, the frame 51 is turned 180° by the rotating portion 52 in a direction indicated by an arrow X relative to the diameter-direction moving table 43, so that the other end portion of the material pipe 1 can be subjected to spin-forming. It is also possible to turn the frame 51 by 180° in the direction of the arrow X relative to the diameter-direction moving table 43, before turning the material pipe 1 by the angle $\alpha$ in the direction of the arrow Y about the axis of the material pipe 1.

Figure 16A:
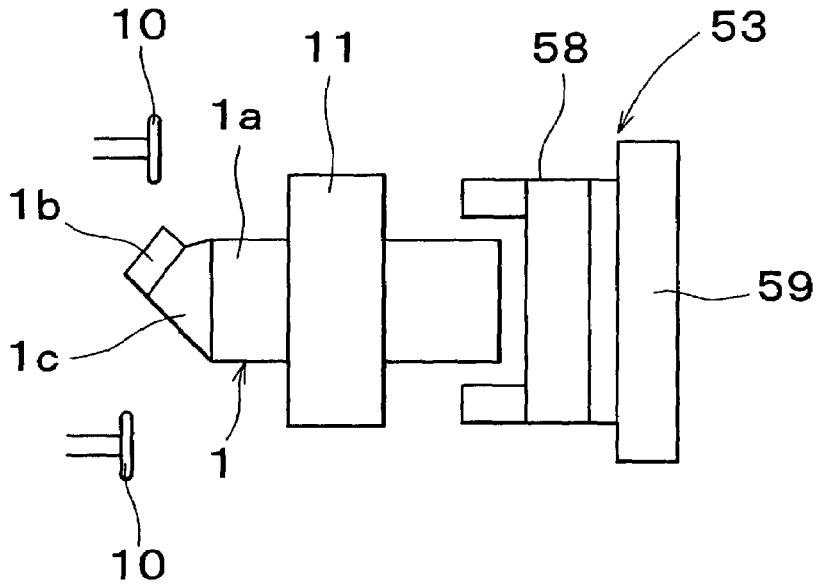
FIGS. 16A to 16D illustrate the construction of still another embodiment of the clamp portion of this invention, and the operation of the clamp portion.
Figure 16B:
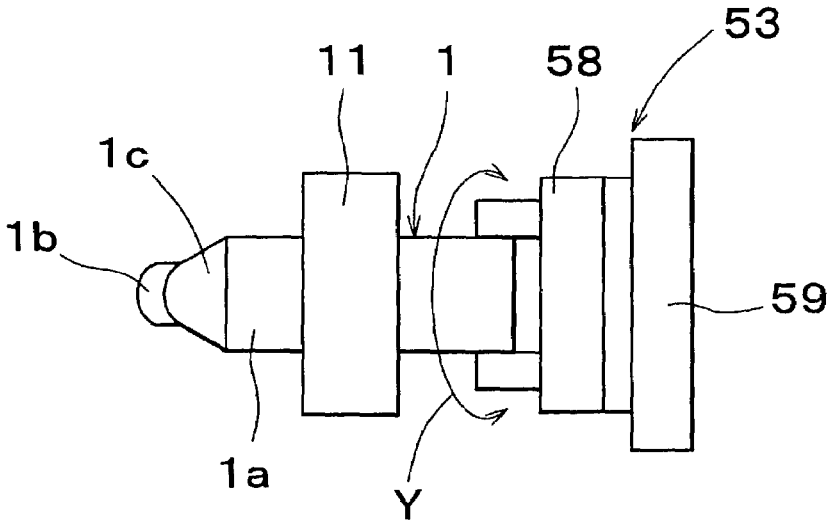

The phase changing portion 53 in the embodiment shown in FIGS. 16 includes a chuck cylinder 58 provided at a side of the frame 51 remote from the roller 10, and a rotary cylinder 59 that supports the chuck cylinder 58 rotatably in the directions indicated by arrows Y (see FIG. 16B). The rotary cylinder 59 is provided so that the rotary cylinder 59 can be moved toward and away from the frame 51.

Figure 16C:
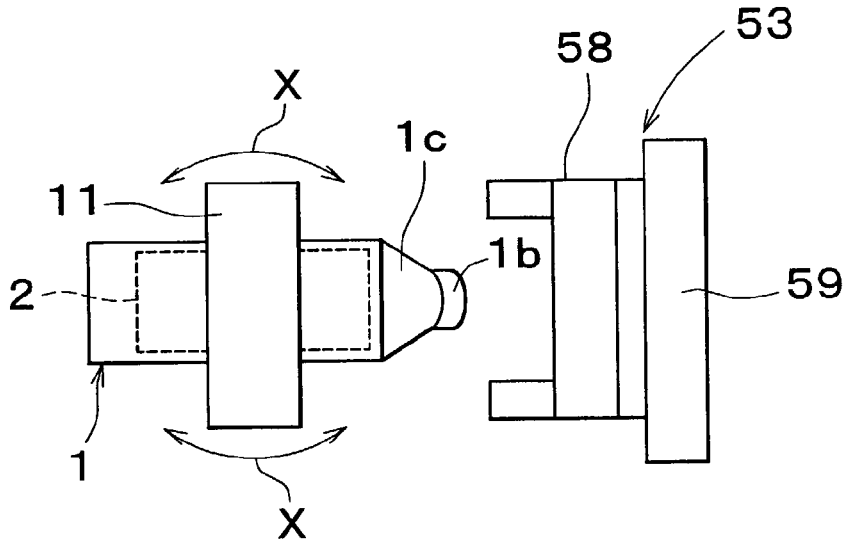
Figure 16D:
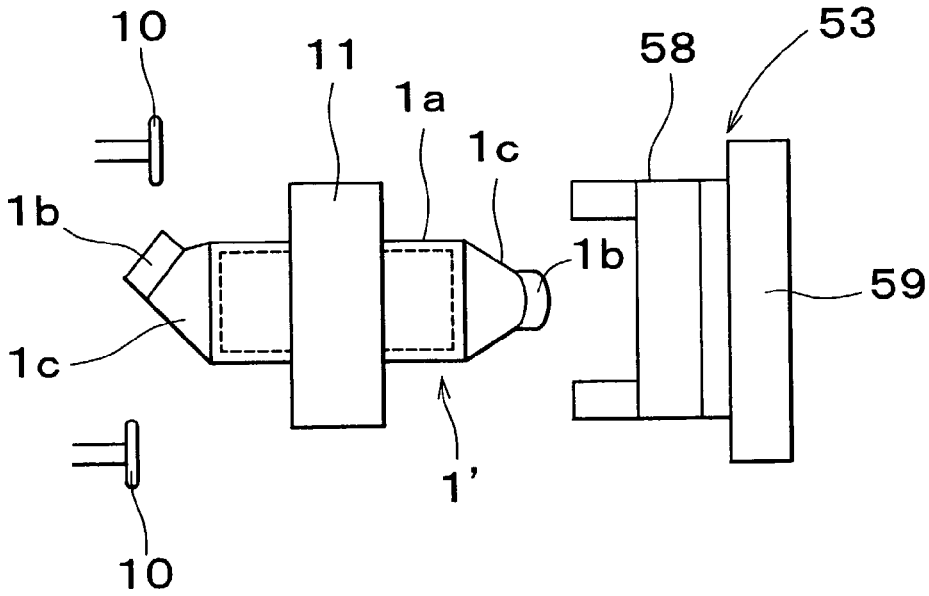

In the clamp portion 11 constructed as described above, after the deflective forming of an end portion of the material pipe 1 is complete, the rotary cylinder 59 is moved closer to the frame (51) while the chuck cylinder 58 is kept open, and the collet chuck (50) is held in an unclamp state as indicated in FIG. 16A. Subsequently, as indicated in FIG. 16B, the chuck cylinder 58 is closed to grip the other end portion of the material pipe 1, and the rotary cylinder 59 is operated to turn the material pipe 1 by the predetermined angle $\alpha$ in the direction of the arrow Y. After that, the collet chuck (50) is set to a clamp state to grip the material pipe 1. Then, as indicated in FIG. 16C, the chuck cylinder 58 is opened, and the rotary cylinder 59 is moved away from the frame (51). In order to allow the spin-forming of the other end portion of the material pipe 1, the rotating portion 52 is operated to turn the frame (51) by 180° in a direction indicated by an arrow X relative to the diameter-direction moving table (43). At or before this time, a catalyst support 2 wound on a mat 3 is inserted into the material pipe 1 from the second (unprocessed) end portion thereof. Then, as indicated in FIG. 16D, the other end portion of the material pipe 1 is defectively formed through spin-forming using the roller 10, so as to form a cone portion 1*c* and a joint portion 1*b*.

In the invention, the clamp portion 11 merely needs to be designed so that the frame 51 can be turned 180° and can be positioned relative to the diameter-direction moving table 43. Unlike the conventional art, it is not necessary to provide a construction for a tilt to a predetermined angle.

Next, an embodiment of the catalytic converter of the invention will be described in detail in conjunction with a case where a catalytic converter is produced using a spin-forming apparatus in accordance with a spin-forming method as described above.

In a catalytic converter of this invention, a catalyst support 2 is disposed within a catalyst container 1'. The catalyst container 1' has a relatively large-diameter catalyst installation portion 1*a* for containing a catalyst support 2, relatively small-diameter joint portions 1*b* that are disposed at opposite ends, and cone portions 1*c* that are formed between the catalyst installation portion 1*a* and the joint portions 1*b*. This allows the diameter of each cone portion 1*c* to be gradually reduced from the catalyst installation portion 1*a* toward the joint portion 1*b*. The catalyst container 1' is formed in a deflective fashion such that the center axis C2 of the joint portion 1*b* and the cone portion 1*c* on each end of the catalyst container 1' forms a predetermined angle θ5 with respect to the center axis C1 of the catalyst installation portion 1*a*. Furthermore, boundary planes K between the cone portions 1*c* and the catalyst installation portion 1*a* of the catalyst container 1' are substantially perpendicular to the center axis C1 of the catalyst installation portion 1*a*.

The catalyst container 1' is formed through the spin-forming of a material pipe 1 and, more specifically, is provided by the forming of the material pipe 1 in accordance with the above-described spin-forming method of the invention.

The catalyst container 1' of the catalytic converter of the invention has, in a substantially middle portion thereof in the direction of length, a relatively large-diameter catalyst installation portion 1*a* in which a catalyst support 2 is contained. Provided at two opposite ends are relatively small-diameter joint portions 1*b* that are connected to an outlet pipe and to an exhaust pipe of an internal combustion engine, respectively. Cone portions 1*c* are formed between the catalyst installation portion 1*a* and the joint portions 1*b* so that each cone portion 1*c* gradually reduces in diameter from the relatively large-diameter catalyst installation portion 1*a* toward the relatively small-diameter joint portion 1*b*. As for the catalyst installation portion 1*a* having the above-described configuration, after the cone portion 1*c* and the joint portion 1*b* at one end are formed through the spin-forming of an end portion of a material pipe 1 having substantially the same diameter as the catalyst installation portion 1*a*, a catalyst support 2 wound on a mat 3 is inserted into the material pipe 1 from the other end thereof. Then, similarly to the first end portion, the other end portion is subjected to the spinning process so as to form a cone portion 1*c* and a joint portion 1*b*. Thus, the catalyst container 1' is formed as a one-piece body. The spin-forming is performed as described above. That is, while the material pipe 1 and the roller 10, which is a forming tool, are revolved relatively to each other with a predetermined radius, the center axis C1 of the material pipe 1 and the revolution axis CK of the roller 10 are eccentrically moved relatively to each other, and simultaneously, the material pipe 1 and the roller 10 are moved relatively to each other in the direction of the axis.

In the above manner, the material pipe 1 and the roller 10 are moved relatively to each other in the direction of progress of the forming. During movement in the direction of progress of the forming, the axis-direction moving portion 13 is controlled so that the roller 10 is moved in the direction (e.g. toward top end) of the axis relative to the material pipe 1 when the circumferential position of the roller 10, with respect to the circumference of the material pipe 1, changes from the inner side of the direction of deflection toward the outer side of the direction of deflection, and so that the movement of the roller 10 relative to the material pipe 1 in the direction of the axis is stopped when the circumferential position of the roller 10 changes from the outer side of the direction of deflection toward the inner side of the direction of deflection. Due to this control, the end portion of the material pipe 1 is deflected at a predetermined angle with respect to the center axis C1 of the catalyst installation portion 1*a*, that is, a portion that is not subjected to the spin-forming. This process is repeated a plurality of times.

In the present embodiment, the movement of the roller 10 relative to the material pipe 1 in the direction of the axis is stopped when the circumferential position of the roller 10 changes from the outer side of the direction of deflection toward the inner side of the direction of deflection. However, it is also appropriate to move the movement of the roller 10 relative to the material pipe 1 in the direction (e.g. toward base end) of the axis.

Figure 19:
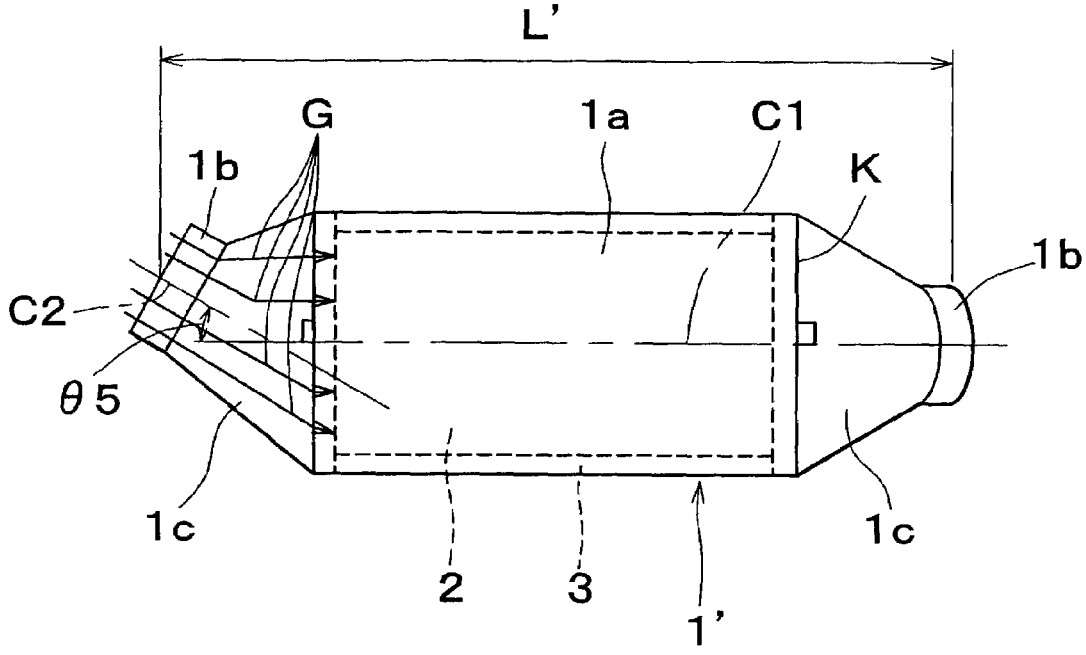
FIG. 19 is an elevation view of a catalyst container in accordance with this invention.
Figure 20:
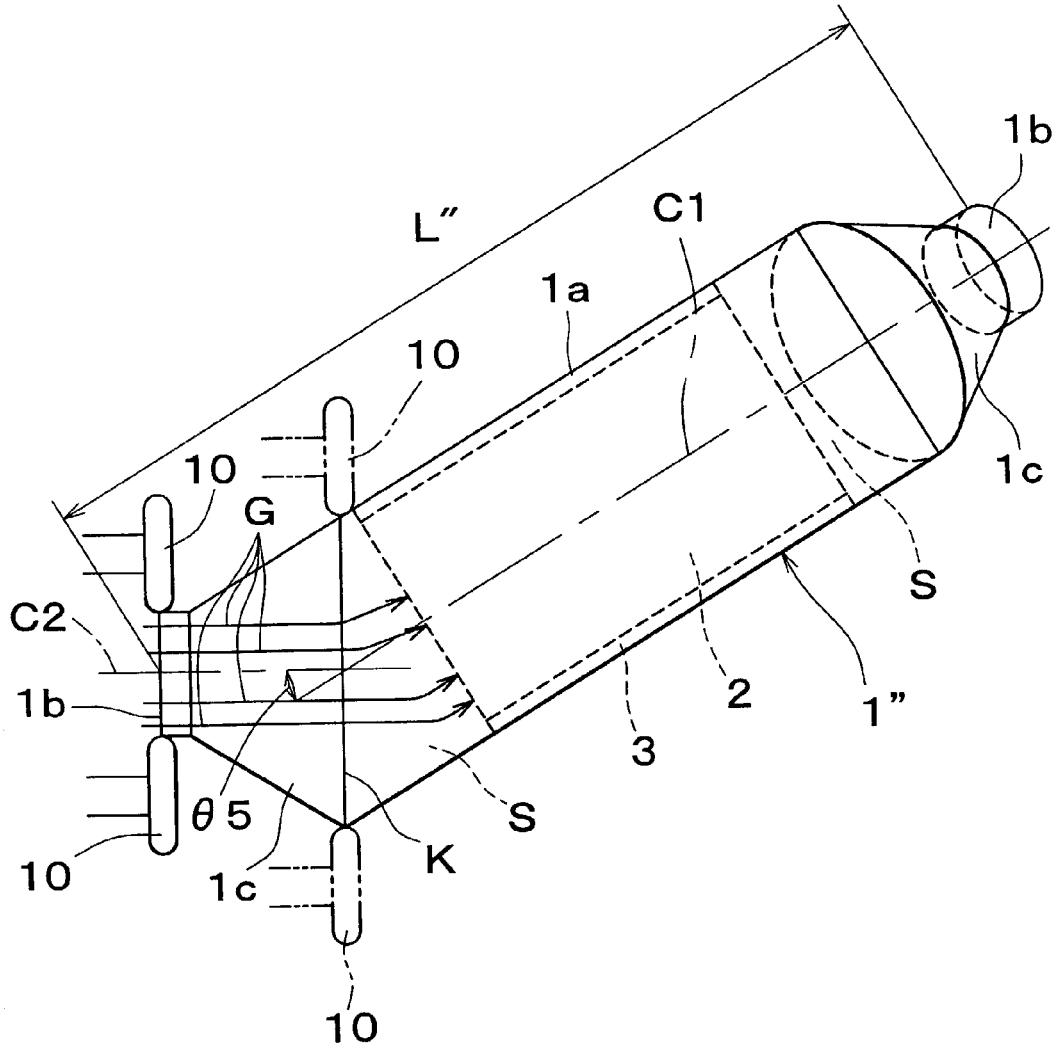
FIG. 20 is an elevation view of a catalyst container produced by a conventional technology.

In the catalyst container 1' of the catalytic converter formed as described above, the center axis C2 of the cone portion 1*c* and the joint portion 1*b* at each end forms a predetermined angle θ5 with respect to the center axis C1 of the catalyst installation portion 1*a* as indicated in FIG. 19. Unlike the conventional related-art technology (FIG. 20), the boundary plane K between each cone portion 1*c* and the catalyst installation portion 1*a* does not form a wedge-shaped space S in conjunction with an adjacent end surface of the catalyst support 2, but is substantially perpendicular to the center axis C1 of the catalyst installation portion 1*a*. Therefore, a flow G of exhaust gas is uniformly introduced to the end surface of the catalyst support 2 from the joint portion 1*b* via the cone portion 1*c*, so that exhaust gas is efficiently cleaned. Furthermore, the entire length L' of the catalytic converter is significantly reduced from the entire length L" in the conventional related-art technology. Therefore, the required space for installation of the catalytic converter is reduced, and the required length of material pipes 1 is also reduced.

The catalyst container 1' of the catalytic converter of the invention is not restricted by the foregoing embodiments in which the catalyst container 1' is formed as a one-piece body by spin-forming a material pipe 1. For example, the catalyst container 1' of the invention also includes a catalyst container formed by joining a catalyst installation portion 1*a*, cone portions 1*c* and joint portions 1*b* that have been formed as separate pieces, provided that the boundary planes between the cone portions 1*c* and the catalyst installation portion 1*a* are substantially perpendicular to the center axis C1 of the catalyst installation portion 1*a*.

According to one exemplary embodiment of the invention the material pipe and a forming tool are revolved relative to each other, and the forming tool is moved relative to the material pipe in a direction of progress of the forming of the material pipe by controlling a movement of the forming tool relative to the material pipe in a direction of an axis synchronously with a circumferential position of the revolving forming tool with respect to a circumference of the material pipe in accordance with a direction of deflection while eccentrically moving a center axis of the material pipe and an axis of revolution of the forming tool relative to each other.

The forming tool (the roller) is controlled to move relative to the material pipe in the direction (e.g. toward top end) of the center axis of the material pipe when the circumferential position of the forming tool, with respect to a circumference of the material pipe, changes from an inner side of the direction of deflection toward an outer side of the direction of deflection. On the other hand, the forming tool is controlled to stop relative to the material pipe in the direction of the center axis of the material pipe or to move relative to the material pipe in an opposite direction (e.g. toward base end) of movement of the forming tool (in a direction toward the base end of the material pipe) while the forming tool moves from an inner side of the direction of deflection toward an outer side of the direction of deflection when the circumferential position of the forming tool (the roller), with respect to a circumference of the material pipe, changes from an outer side of the direction of deflection toward an inner side of the direction of deflection. Therefore, material of the material pipe flows to allow axial elongation at the outer side of the direction of deflection, or to allow axial contraction at the inner side of the direction of deflection. Hence, unlike the conventional related-art technology, a material pipe can be easily deflected at a predetermined angle without the need for a workpiece tilting portion. Furthermore, it becomes possible to provide a spin-forming method capable of appropriately pressing a material pipe and reducing it in diameter with good precision through the use of a forming tool.

A spin-forming apparatus including a revolutionary drive portion that revolves the forming tool relative to the material pipe, an axis-direction moving portion that moves the forming tool relative to the material pipe in a direction of an axis, and a radial-direction moving portion that eccentrically moves the forming tool relative to the material pipe by moving the forming tool relative to the material pipe in a radial direction, is provided with a reciprocating portion that reciprocally moves the material pipe and the forming tool relative to each other in the direction of the axis synchronously with a circumferential position of the revolving forming tool with respect to a circumference of the material pipe in accordance with the direction of deflection. Therefore, by controlling the reciprocating movements of the forming tool in the directions of the axis, material of the material pipe flows to allow elongation in a deflection direction at the outer side portion in the direction of the axis, or for contraction in a deflection direction at the inner side portion in the direction of the axis. Hence, unlike the conventional related-art technology, a material pipe can be easily deflected at a predetermined angle at low cost without the need for a workpiece tilting portion. Furthermore, it becomes possible to provide a spin-forming apparatus capable of appropriately pressing a material pipe and reducing it in diameter with good precision through the use of a forming tool.

A catalyst container of a catalytic converter, deflected so that the center axis of the joint portion and the cone portion forms a predetermined angle with respect to the center axis of the catalyst installation portion, is formed so that a boundary plane between the catalyst installation portion and the cone portion is substantially perpendicular to the center axis of the catalyst installation portion. Unlike the conventional related-art technology, the boundary plane K between the cone portion and the catalyst installation portion does not form a wedge-shaped space in conjunction with an adjacent end surface of the catalyst support, but is substantially perpendicular to the center axis of the catalyst installation portion. Therefore, a flow of exhaust gas is uniformly introduced to the end surface of the catalyst support from the joint portion via the cone portion, so that exhaust gas is efficiently cleaned. Furthermore, the entire length of the catalytic converter is significantly reduced. Therefore, the required space for installation of the catalytic converter is reduced. Furthermore, the required length of a material pipe for the catalytic converter is also reduced.

While the invention has been described with reference to the exemplary embodiments outlined above, it is to be understood that the invention is not limited to the disclosed embodiments or constructions. On the contrary, the invention is intended to cover various alternatives, modifications, variations and equivalent arrangements. In addition, while the various elements of the disclosed invention are shown in various combinations and configurations, which are exemplary, other combinations and configurations are also within the spirit and scope of the invention. As such, various changes may be made without departing from the spirit and scope of the invention as defined in the following claims.

What is claimed is:

1. A method of spin-forming for deflecting a material pipe at a predetermined angle, comprising:

revolving the material pipe and a forming tool relative to each other; and moving the forming tool relative to the material pipe, in a direction of progress of the forming of the material pipe while a center axis of the material pipe and an axis of revolution of the forming tool are eccentrically moved relative to each other, by controlling a movement of the forming tool relative to the material pipe in a direction of an axis of revolution in accordance with a direction of deflection, wherein the movement of the forming tool is controlled synchronously with a circumferential position of the forming tool that is revolving with respect to a circumference of the material pipe, and wherein the center axis of the material pipe is parallel to the axis of revolution of the forming tool.

2. A method of spin-forming for deflecting a material pipe at a predetermined angle, comprising:

revolving the material pipe and a forming tool relative to each other; and moving the forming tool relative to the material pipe, in a direction of progress of the forming of the material pipe while a center axis of the material pipe and an axis of revolution of the forming tool are eccentrically moved relative to each other, by controlling a movement of the forming tool relative to the material pipe in a direction of an axis of revolution in accordance with a direction of deflection, wherein the movement of the forming tool is controlled synchronously with a circumferential position of the forming tool that is revolving with respect to a circumference of the material pipe, wherein movement of the material pipe and the forming tool is controlled by:

allowing movement in one direction of the center axis of the material pipe when the forming tool moves from an inner side of the direction of deflection toward an outer side of the direction of deflection; and stopping the movement in the direction of the center axis of the material pipe or allowing movement in the other direction of the center axis of the material pipe when the forming tool moves from the outer side of the direction of deflection toward the inner side of the direction of deflection.

3. A spin-forming apparatus for deflecting a material pipe at a predetermined angle, comprising:

a revolutionary drive portion that revolves a forming tool relative to the material pipe;

an axis-direction moving portion that moves the forming tool relative to the material pipe in a direction of an axis of revolution of the forming tool;

a radial-direction moving portion that eccentrically moves the forming tool relative to the material pipe by moving the forming tool relative to the material pipe in a radial direction; and a reciprocating portion that reciprocally moves the material pipe and the forming tool relative to each other in the direction of the axis of revolution synchronously with a circumferential position of the revolving forming tool with respect to a circumference of the material pipe in accordance with a direction of deflection, wherein a center axis of the material pipe is parallel to the axis of revolution of the forming tool.

4. The spin-forming apparatus according to claim 3, wherein a plurality of forming tools are provided, and are equidistantly disposed along a circumference of the material pipe.

5. The spin-forming apparatus according to claim 3, further comprising a clamp portion that grips the material pipe, wherein the clamp portion includes a turning portion that turns the material pipe about an axis that is perpendicular to a center axis of the material pipe.

6. The spin-forming apparatus according to claim 3, further comprising a clamp portion that grips the material pipe, wherein the clamp portion includes a phase changing portion that turns the material pipe about a center axis of the material pipe.

7. A spin-forming apparatus for deflecting a material pipe at a predetermined angle, comprising:

a revolutionary drive portion that revolves a forming tool relative to the material pipe;

an axis-direction moving portion that moves the forming tool relative to the material pipe in a direction of an axis of revolution of the forming tool;

a radial-direction moving portion that eccentrically moves the forming tool relative to the material pipe by moving the forming tool relative to the material pipe in a radial direction; and a reciprocating portion that reciprocally moves the material pipe and the forming tool relative to each other in the direction of the axis of revolution synchronously with a circumferential position of the revolving forming tool with respect to a circumference of the material pipe in accordance with a direction of deflection, wherein the reciprocating portion moves the material pipe and the forming tool relative to each other in one direction of the axis of revolution when the forming tool moves from an inner side of the direction of deflection toward an outer side of the direction of deflection, and wherein the reciprocating portion stops moving the material pipe and the forming tool relative to each other in the direction of the axis of revolution or moves in the other direction of the center axis of the material pipe when the forming tool moves from the outer side of the direction of deflection toward the inner side of the direction of deflection.

* * * * *